United States Patent [19]

Morimoto et al.

[11] Patent Number: 4,851,325

[45] Date of Patent: Jul. 25, 1989

[54] PROCESS FOR PRODUCING SILVER HALIDE COLOR PHOTOGRAPHIC MATERIALS COMPRISING A HETEROCYCLIC DEVELOPING AGENT

[75] Inventors: Kiyoshi Morimoto; Hideaki Naruse, both of Kanagawa, Japan

[73] Assignee: Fuji Photo Film Co., Inc., Kanagawa, Japan

[21] Appl. No.: 294,967

[22] Filed: Dec. 30, 1988

Related U.S. Application Data

[63] Continuation of Ser. No. 72,479, Jul. 13, 1987, abandoned.

[30] Foreign Application Priority Data

Jul. 12, 1986 [JP] Japan ..... 61-164515
Oct. 8, 1986 [JP] Japan ..... 61-238073

[51] Int. Cl.[4] ..... G03C 7/30; G03C 5/24; G03C 7/00

[52] U.S. Cl. ..... 430/372; 430/380; 430/434; 430/440; 430/464; 430/467; 430/483; 430/484; 430/485; 430/490

[58] Field of Search ..... 430/372, 380, 434, 440, 430/464, 467, 483, 484, 485, 490, 493

[56] References Cited

U.S. PATENT DOCUMENTS

| | | | |
|---|---|---|---|
| 1,937,844 | 3/1931 | Reed | 430/440 |
| 3,287,125 | 11/1966 | Green et al. | 430/484 |
| 3,293,034 | 12/1966 | Green et al. | 430/484 |
| 3,996,054 | 12/1976 | Santemma et al. | 430/372 |
| 4,001,020 | 1/1977 | Hayashi et al. | 430/440 |
| 4,299,913 | 11/1981 | Wernicke | 430/490 |
| 4,585,728 | 4/1986 | Furutachi et al. | 430/376 |

FOREIGN PATENT DOCUMENTS

| | | | |
|---|---|---|---|
| 0147350 | 8/1984 | Japan | 430/440 |
| 158446 | 8/1985 | Japan . | |

*Primary Examiner*—Paul R. Michl
*Assistant Examiner*—Patrick Doody
*Attorney, Agent, or Firm*—Sughrue, Mion, Zinn, Macpeak & Seas

[57] ABSTRACT

A process for processing silver halide color photographic materials, which comprises processing, after image-wise exposure, a silver halide color photographic material with a color developer containing an aromatic primary amine color developing agent and a compound represented by the following general formula (I):

(I)

wherein n represents an integer of at least 1; R represents a hydrogen atom, a substituted or unsubstituted alkyl group, a substituted or unsubstituted aryl group, a substituted or unsubstituted heterocyclic group or the n-valent groups corresponding to the groups when n represents an integer of at least 2; and A represents an organic group containing a carbon atom, an oxygen atom, a nitrogen atom, or a sulfur atom and forms a saturated or unsaturated 3- to 8-membered ring with the nitrogen atom, said A is substituted or unsubstituted and may be condensed with a benzene ring or a heterocyclic ring.

7 Claims, No Drawings

PROCESS FOR PRODUCING SILVER HALIDE COLOR PHOTOGRAPHIC MATERIALS COMPRISING A HETEROCYCLIC DEVELOPING AGENT

This is a continuation of application Ser. No. 07/072,479 filed July 13, 1987, now abandoned.

FIELD OF THE INVENTION

This invention relates to a process for processing silver halide color photographic materials and, more particularly, the invention relates to a color photographic process using a color developer having improved stability and coloring property and giving greatly reduced formation of fog in continuous processing.

BACKGROUND OF THE INVENTION

A color photographic developer (hereinafter simply referred to as "color developer") using an aromatic primary amine color developing agent has been used for a long time for forming color images and at present plays a central role in color photographic image forming processes. However, as is well known, the aforesaid color developer is very liable to be oxidized by air and metals and if color images are formed using such a deteriorated color developer, undesirable photographic properties such as an increase of fog and a change of sensitivity and gradation occur.

Therefore, various means for improving the storage stability of color developers have been investigated and a method of using hydroxylamine and a sulfite ion together has been proposed as the most general means. However, such a means has disadvantages in that hydroxylamine generates ammonia when it is decomposed, which causes fog and also sulfite ion reacts with a competing compound of a color developing agent to reduce the coloring property and hence these components are not good preservatives.

Furthermore, for improving the stability of color developers, various kinds of preservatives and chelating agents have been investigated. For example, as preservatives, there are aromatic polyhydroxy compounds described in Japanese Patent Application (OPI) Nos. 49828/77, 160142/84 and 47038/81 (the term "OPI" as used herein means an "unexamined published application") and U.S. Pat. No. 3,746,544, hydroxycarbonyl compounds described in U.S. Patent 3,615,503 and British Pat. No. 1,306,176, α-aminocarbonyl compounds described in Japanese Patent Application (OPI) Nos. 143020/77 and 89425/78, alkanolamines described in Japanese Patent Application (OPI) No. 3532/79, and metal salts described in Japanese Patent Application (OPI) Nos. 44148/82 and 53749/82. Also, as chelating agents, there are aminopolycarboxylic acids described in Japanese Patent Publication Nos. 30496/73 and 30232/69, organic phosphonic acids described in Japanese Patent Application (OPI) No. 97347/81, Japanese Patent Publication No. 39359/81, and West German Pat. No. 2,227,639, phosphonocarboxylic acids described in Japanese Patent Application (OPI) Nos. 102726/77, 42730/78, 121127/79, 126241/80 and 65956/80, and other compounds described in Japanese Patent Application (OPI) Nos. 195845/83 and 203440/83 and Japanese Patent Publication No. 40900/88.

However, when these conventional techniques are used, the storage stability obtained is still insufficient or they exert some bad influences on the photographic properties and sufficient results have not yet been obtained by these techniques.

In particular, in a color developer containing no benzyl alcohol which is a problem for the prevention of pollution and the preparation of the developer, the coloring property is inevitably deteriorated and in such a system, since a preservative which acts as a competing compound remarkably reduces the coloring property, the aforesaid techniques are also insufficient.

Furthermore, a color photographic light-sensitive material containing a silver chlorobromide emulsion having high chlorine content is liable to form fog at color development as described in Japanese Patent Application (OPI) Nos. 95345/83 and 232342/84. In the case of using such a silver halide emulsion, the use of a preservative exhibiting dissolving property for the emulsion and having a more excellent preservative faculty is inevitable and in this content, the development of a novel excellent color developer has been desired.

SUMMARY OF THE INVENTION

An object of this invention is, therefore, to provide a developer composition for silver halide color photographic materials having excellent stability and coloring property and giving much less increase of fog at continuous processing.

Furthermore, another object of this invention is to provide a color developer composition which is excellent in stability without reducing coloring density even in the case of containing substantially no benzyl alcohol.

A further object of this invention is to provide a process for processing silver halide color photographic materials preventing the increase of fog using a color developer having improved stability and showing much less change of developing faculty with the passage of time in continuous processing.

It has now been discovered that the above-described objects can be attained by the present invention as set forth below.

That is, the invention is a process for processing silver halide color photographic materials, which comprises processing a silver halide color photographic material, after imagewise exposure, with a color developer containing an aromatic primary amine color developing agent and a compound represented by the following general formula (I):

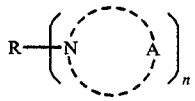

(I)

wherein n represents an integer of at least 1; R represents a hydrogen atom, a substituted or unsubstituted alkyl group, a substituted or unsubstituted aryl group, a substituted or unsubstituted heterocyclic group or the n-valent groups corresponding to the groups when n represents an integer of at least 2; and A represents an organic group containing a carbon atom, an oxygen atom, a nitrogen atom, or a sulfur atom and forms a saturated or unsaturated 3- to 8-membered ring with the nitrogen atom, said A is substituted or unsubstituted and may be condensed with a benzene ring or a heterocyclic ring.

DETAILED DESCRIPTION OF THE INVENTION

The compound represented by the general formula (I) described above is explained in detail.

In the general formula (I), R represents a hydrogen atom, an alkyl group, an aryl group, a heterocyclic group or the n-valent groups corresponding to the groups as described above and the alkyl group, aryl group, heterocyclic group and n-valent groups corresponding to the groups may have one or more substituents. Examples of the substituents are a hydroxy group, an alkoxy group, an acyloxy group, an acylamino group, a sulfonylamino group, an alkylsulfonylamino group, an alkoxycarbonyl group, a cyano group, a nitro group, a halogen atom, a sulfo group, a carboxy group, a ureido group, a carbamoyl group, and a sulfamoyl group. In addition, R is a n-valent group and is not limited to a univalent group. In other words, when R is a n-valent group and n is 2 or more, the n-valent groups corresponding to the above-illustrated groups are preferred as R.

When R is a univalent group, R represents a hydrogen atom, a substituted or unsubstituted alkyl group having 1 to 24 carbon atoms (e.g., methyl, ethyl, n-propyl, n-butyl, hydroxyethyl, sulfopropyl, carboxyethyl, alkylsulfonylaminoethyl, sulfobutyl, etc.), a substituted or unsubstituted aryl group having 6 to 32 carbon atoms (e.g., phenyl, p-hydroxyphenyl, p-carboxyphenyl, p-sulfophenyl, etc.), or a substituted or unsubstituted 3- to 8-membered heterocyclic group containing at least one of a carbon atom, an oxygen atom, a nitrogen atom, and a sulfur atom (e.g., 3-1,2,4-triazolyl, 2-1,2-pyrimidyl, etc.), and when R is a divalent group, R represents a substituted or unsubstituted alkylene group having 2 to 18 carbon atoms (e.g., ethylene, propylene, trimethylene, tetramethylene, pentamethylene, 2-hydroxytrimethylene, etc., preferably, ethylene, propylene, trimethylene and 2-hydroxytrimethylene) or a substituted or unsubstituted arylene group having 6 to 20 carbon atoms (e.g., phenylene, substituted phenylene, etc.).

R is preferably a hydrogen atom, a substituted or unsubstituted alkyl group or a substituted or unsubstituted alkylene group. Also, R is more preferably an alkyl group or alkylene group substituted by a hydrophilic function group such as a hydroxy group, a sulfo group, a sulfonylamino group, a sulfamoyl group, etc. When R is a substituted or unsubstituted alkyl group or a substituted or unsubstituted alkylene group, it is preferred that the carbon number thereof is from 1 to 10.

In the general formula (I), A represents an organic group containing a carbon atom, an oxygen atom, a nitrogen atom, or a sulfur atom and forms a saturated or unsaturated 3- to 8-membered ring with the nitrogen atom. Furthermore, A may have one or more substituents or may be condensed with a benzene ring or a heterocyclic ring. Examples of the substituents which may exist for A are those illustrated above as the substituents for R. In a preferred embodiment, A represents an organic group containing a carbon atom, an oxygen atom or a nitrogen atom and forms a saturated or unsaturated 5-membered or 6-membered ring with the nitrogen atom.

In the general formula (I), n represents an integer of at least 1. That is, there is no particular restriction on the upper limit of n and the compound shown by the general formula (I) may be a high molecular weight compound if the compound is soluble in water but it is preferred that n is usually in the range of from 1 to 3, and it is particularly preferred that n is 1 or 2.

Specific examples of the compound shown by the general formula (I) described above are illustrated below although the compounds for use in this invention are not limited to these compounds.

I-(1)

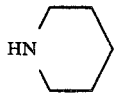

I-(2)

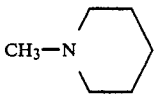

I-(3)

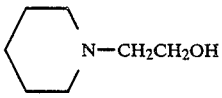

I-(4)

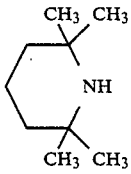

I-(5)

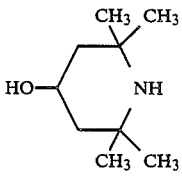

I-(6)

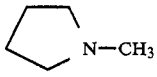

I-(7)

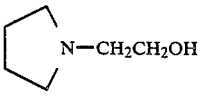

I-(8)

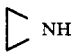

I-(9)

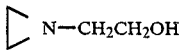

I-(10)

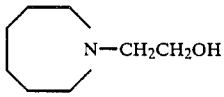

-continued
I-(11)
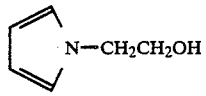
I-(12)
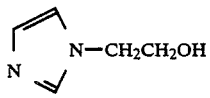
I-(13)
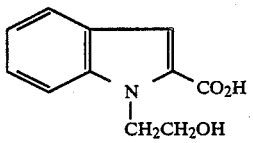
I-(14)
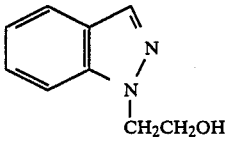
I-(15)
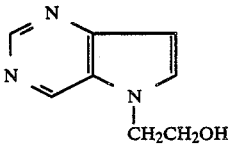
I-(16)
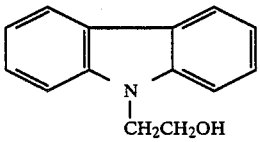
I-(17)
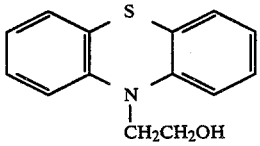
I-(18)
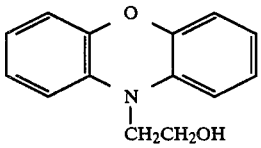
I-(19)
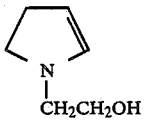
I-(20)
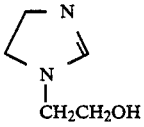
I-(21)
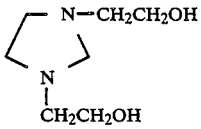
I-(22)
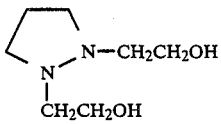
I-(23)
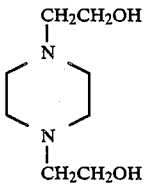
I-(24)
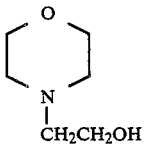
I-(25)
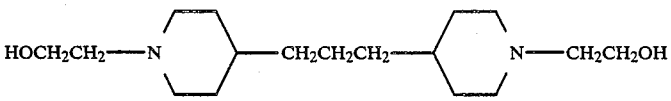
I-(26)
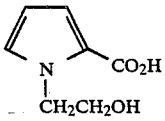
I-(27)
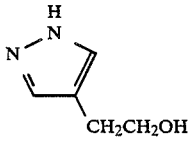
I-(28)
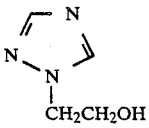
I-(29)
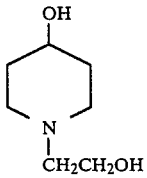

-continued
I-(30)
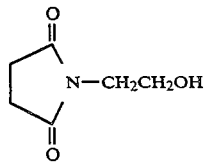
I-(31)
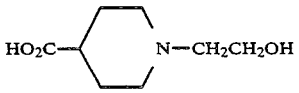
I-(32)
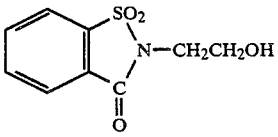
I-(33)
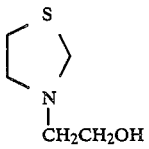
I-(34)
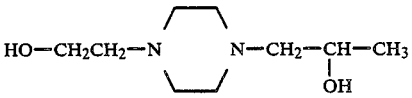
I-(35)
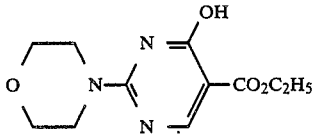
I-(36)
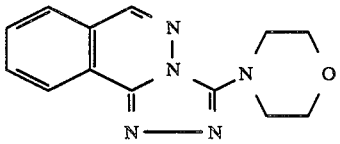
I-(37)
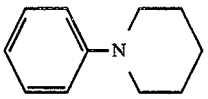
I-(38)
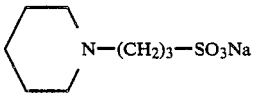
I-(39)
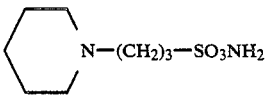
I-(40)
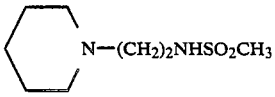
I-(41)
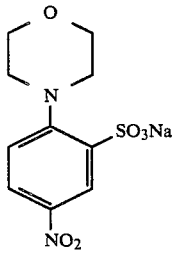
I-(42)
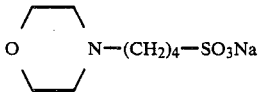
-continued
I-(43)
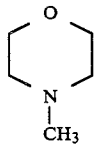
I-(44)
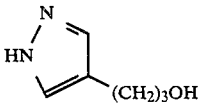
I-(45)
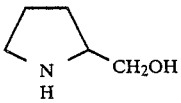
I-(46)
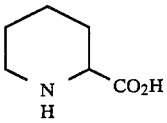
I-(47)
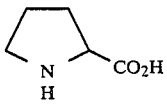
I-(48)
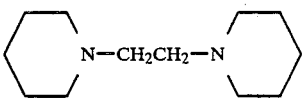
I-(49)
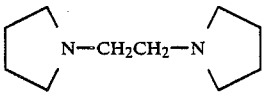
I-(50)
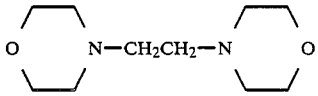
I-(51)
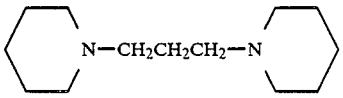

-continued

I-(52)

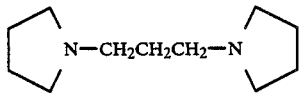

I-(53)

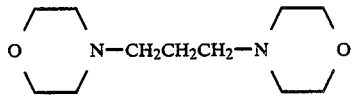

I-(54)

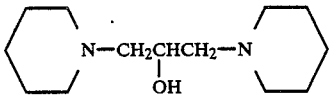

I-(55)

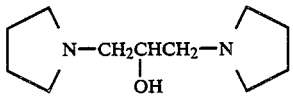

I-(56)

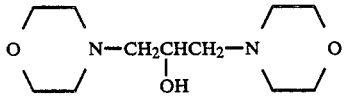

I-(57)

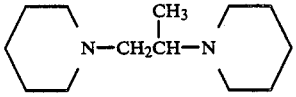

I-(58)

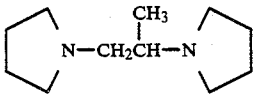

I-(59)

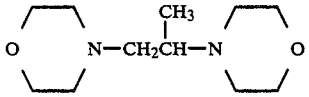

I-(60)

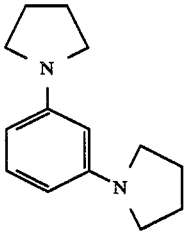

I-(61)

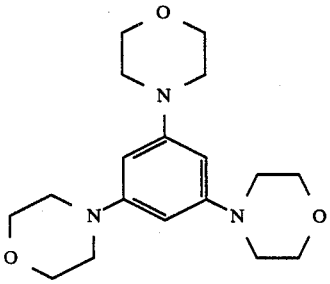

Synthesis examples of the compounds of the general formula (I) for use in this invention are shown below.

Synthesis of Compound I-(2)

In 50 ml of water were dissolved 8.5 g of piperidine and 6 g of sodium hydroxide and after adding dropwise 18.9 g of dimethylsulfuric acid to the solution, the resultant mixture was refluxed with heating for 2 hours. The reaction mixture was allowed to cool, extracted with ethyl acetate, and the extract was distilled under reduced pressure to provide 5.5 g (yield: 55%) of Compound I-(2).

Synthesis of Compound I-(3)

In 50 ml of water were dissolved 8.5 g of piperidine and 6 g of sodium hydroxide and after adding dropwise 12 g of ethylenechlorohydrin to the solution, the resultant mixture was refluxed with heating for 4 hours. The reaction mixture was allowed to cool, extracted with ethyl acetate, and the extract was distilled under reduced pressure to provide 5.8 g (yield: 45%) of Compound I-(3).

The content of the compound shown by the general formula (I) is from 0.01 to 50 g, and preferably from 0.1 to 20 g per liter of the color developer.

Next, the color developer for use in this invention is explained.

The color developer in this invention contains a known aromatic primary amine color developing agent. Preferred examples thereof are p-phenylenediamine derivatives and specific examples of these derivatives are shown below but the invention is not limited to these derivatives.

D-1: N,N-diethyl-p-phenylenediamine

D-2: 2-amino-5-diethylaminotoluene

D-3: 2-amino-5-(N-ethyl-N-laurylamino)toluene

D-4: 4-[N-ethyl-N-(β-hydroxyethyl)amino]aniline

D-5: 2-methyl-4-[N-ethyl-N-(β-hydroxyethyl-)amino]aniline

D-6: N-ethyl-N-(β-methanesulfonamidoethyl)-3-methyl-4-aminoaniline

D-7: N-(2-amino-5-diethylaminophenylethyl)methanesulfonamide

D-8: N,N-dimethyl-p-phenylenediamine

D-9: 4-amino-3-methyl-N-ethyl-N-methoxyethylaniline

D-10: 4-amino-3-methyl-N-ethyl-N-β-ethoxyethylaniline

D-11: 4-amino-3-methyl-N-ethyl-N-β-butoxyethylaniline

Also, these p-phenylenediamine derivatives may be salts such as sulfates, hydrochlorides, sulfites, p-toluenesulfonates, etc. The amount of the aromatic primary amine developing agent is from about 0.1 g to about 20 g, and preferably from about 0.5 g to about 10 g per liter of the color developer.

In a preferred embodiment of this invention, the color developer further contains a hydroxylamine represented by the following general formula (II):

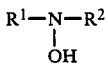

(II)

wherein $R^1$ and $R^2$, which may be the same or different, each represents a hydrogen atom, a substituted or unsubstituted alkyl group, a substituted or unsubstituted alkenyl group, or a substituted or unsubstituted aryl group.

In the general formula (II), $R^1$ and $R^2$ each represents a hydrogen atom, an alkyl group (e.g., methyl, ethyl, etc.), an alkenyl group (e.g., 2-propylene, etc.), or an aryl group (e.g., phenyl, etc.), and the alkyl group, alkenyl group and aryl group may have one or more substituents.

It is preferred that $R^1$ and $R^2$ are an alkyl group or an alkenyl group and it is more preferred that at least one of $R^1$ and $R^2$ has a substituent. Furthermore, $R^1$ and $R^2$ may combine with each other to form a heterocyclic ring with the nitrogen atom.

The alkyl group and alkenyl group may be straight chain, branched, or cyclic. Examples of the substituent for the groups shown by $R^1$ and $R^2$ are a halogen atom (e.g., a fluorine atom, a chlorine atom, a bromine atom, etc.), an aryl group (e.g., a phenyl group, a p-chlorophenyl group, etc.), an alkoxy group (e.g., a methoxy group, an ethoxy group, a methoxyethoxy group, etc.), an aryloxy group (e.g., a phenoxy group, etc.), a sulfonyl group (e.g., a methanesulfonyl group, a p-toluenesulfonyl group, etc.), a sulfonamido group (e.g., a methanesulfonamido group, a benzenesulfonamido group, etc.), a sulfamoyl group (e.g., a diethylsulfamoyl group, an unsubstituted sulfamoyl group, etc.), a carbamoyl group (e.g., an unsubstituted carbamoyl group, a diethylcarbamoyl group, etc.), an amido group (e.g., an acetamido group, a benzamido group, etc.), a ureido group (e.g., a methylureido group, a phenylureido group, etc.), an alkoxycarbonylamino group (e.g., a methoxycarbonylamino group, etc.), an aryloxycarbonylamino group (e.g., a phenoxycarbonylamino group, etc.), an alkoxycarbonyl group (e.g., a methoxycarbonyl group, etc.), an aryloxycarbonyl group (e.g., a phenoxycarbonyl group, etc.), a cyano group, a hydroxy group, a carboxy group, a sulfo group, a nitro group, an amino group (e.g., an unsubstituted amino group, a diethylamino group, etc.), an alkylthio group (e.g., a methylthio group, etc.), an arylthio group (e.g., a phenylthio group, etc.), and a heterocyclic group (e.g., a morpholino group, a pyridyl group, etc.).

In this case, $R^1$ and $R^2$ may be the same or different and also the substituents for $R^1$ and $R^2$ may be the same or different.

Examples of the substituted alkyl group shown by $R^1$ or $R^2$ are a methoxyethyl group, an ethoxyethyl group, a methoxyethoxyethyl group, a benzyl group, a hydroxyethyl group, a carboxymethyl group, etc.

Also, the carbon atom number of the group shown by $R^1$ or $R^2$ is preferably from 1 to 10, and particularly preferably from 1 to 5. Examples of the nitrogen-containing heterocyclic group formed by the combination of $R^1$ and $R^2$ are a piperidyl group, a pyrrolidyl group, an N-alkylpiperidyl group, a morpholyl group, an indolinyl group, and a benztriazolyl group.

Preferred examples of the substituent for the groups shown by $R^1$ or $R^2$ are a hydroxy group, an alkoxy group, an alkylsulfonyl group, an arylsulfonyl group, an amido group, a carboxy group, a cyano group, a sulfo group, a nitro group, and an amino group.

Specific examples of the compound shown by the general formula (II) described above are illustrated below but the compounds of the general formula (II) are not limited to them.

II-(1)

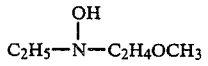

II-(2)

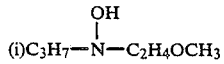

II-(3)

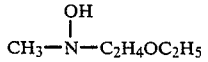

-continued

II-(4)

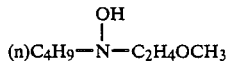

II-(5)

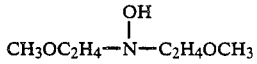

II-(6)

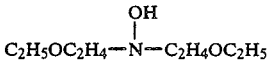

II-(7)

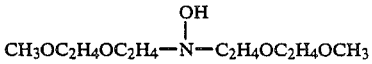

II-(8)

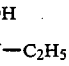

II-(9)

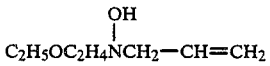

II-(10)

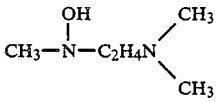

II-(11)

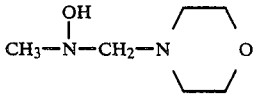

II-(12)

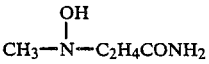

II-(13)

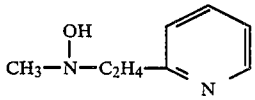

II-(14)

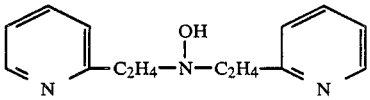

II-(15)

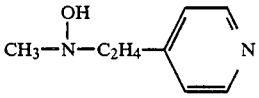

II-(16)

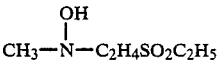

II-(17)

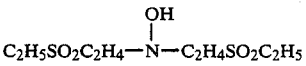

II-(18)

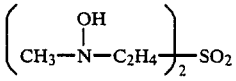

II-(19)

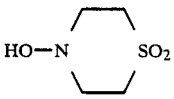

II-(20)

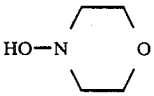

-continued

II-(21)

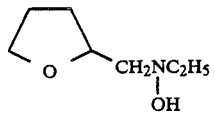

II-(22)

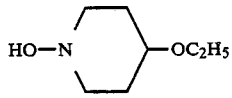

II-(23)

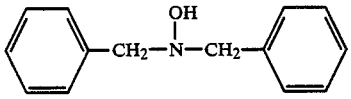

II-(24)

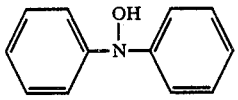

II-(25)

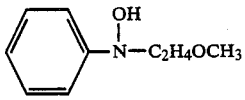

II-(26)

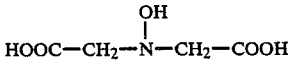

II-(27)

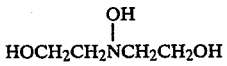

II-(28)

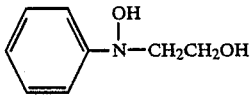

II-(29)

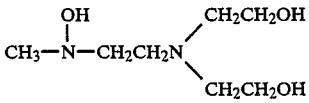

II-(30)

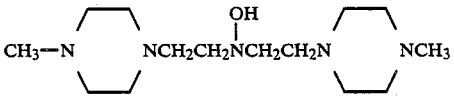

II-(31)

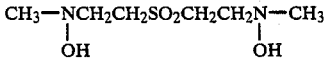

II-(32)

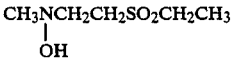

II-(33)

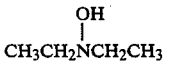

II-(34)

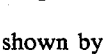

The compounds shown by the general formula (II) described above can be synthesized by the methods described, for example, in U.S. Pat. Nos. 3,661,996, 3,362,961, 3,293,034, 3,491,151, 3,655,764, 3,467,711, 3,455,916, 3,287,125 and 3,287,124, and Japanese Patent Publication No. 2794/67.

These compounds may form salts with various acids such as hydrochloric acid, sulfuric acid, nitric acid, phosphoric acid, oxalic acid, acetic acid, etc.

The addition amount of the compound shown by the general formula (II) to the color developer is from 0.1 g to 20 g, and preferably from 0.5 g to 10 g per liter of the color developer.

It is preferred that the color developer in this invention contains substantially no benzyl alcohol from the standpoint of minimizing pollution, simplifying the preparation of the color developer, and preventing the occurrence of fog. In this case, the term "containing substantially no benzyl alcohol" means that the color developer contains less than 2 ml of benzyl alcohol per liter of the color developer, and preferably contains no benzyl alcohol.

Also, the color developer in this invention may further contain, if necessary, a sulfite such as sodium sulfite, potassium sulfite, sodium bisulfite, potassium bisulfite, sodium metasulfite, potassium metasulfite, etc., or a carbonylsulfite adduct as a preservative. The addition amount of the preservative is from 0 to 20 g, and preferably from 0 to 5 g per liter of the color developer. In addition, the amount of such a preservative is as small as possible if the stability of the color developer can be maintained.

Examples of other preservatives which can be used for the color developers in this invention are hydroxyacetones described in U.S. Pat. No. 3,615,503 and British Pat. No. 1,306,176, α-aminocarbonyl compounds described in Japanese Patent Application (OPI) Nos. 143020/77 and 89425/78, various kinds of metals described in Japanese Patent Application (OPI) Nos. 44148/82 and 53749/82, various kinds of saccharides described in Japanese Patent Application (OPI) No. 102727/77, hydroxamic acids described in Japanese Patent Application (OPI) No. 27638/77, α,α'-dicarbonyl compounds described in Japanese Patent Application (OPI) No. 160141/84, salicylic acids described in Japanese Patent Application (OPI) No. 180588/84, alkanolamines described in Japanese Patent Application (OPI) No. 3532/79, poly(alkyleneimines) described in Japanese Patent Application (OPI) No. 94349/81, gluconic acid derivatives described in Japanese Patent Application (OPI) No. 75647/81, etc.

The aforesaid preservatives may be used singly or in combination.

Also, an aromatic polyhydroxy compound may be preferably used in the color developer as a preservative in this invention.

The pH of the color developer for use in this invention is preferably from about 9 to about 12, more preferably from about 9 to about 11.0, and also the color developer may further contain other additives which are ordinarily employed in color developers.

For maintaining the aforesaid pH of color developer, it is preferred to use various buffers. As such buffers, there are carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. In particular, the use of carbonates, phosphates, tetraborates, or hydroxybenzoates is preferred since they are excellent in solubility, and also with the buffer action at the high pH range of higher than 9.0, they result in no adverse influences (e.g., the formation of fog, etc.) to the photographic performance when they are added to the color developer, and they are available at low cost.

Specific examples of these buffers are sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, this invention is not limited to these compounds.

The addition amount of the buffer is preferably not less than 0.1 mol, and more preferably from 0.1 mol to 0.4 mol per mol of the color developer.

Furthermore, the color developer in this invention may contain various chelating agents as a precipitation preventing agent for calcium and magnesium, and for improving the stability of the color developer.

As the chelating agent, organic acid compounds are preferred, and examples thereof are aminopolycarboxylic acids described in Japanese Patent Publication Nos. 30496/73 and 30232/69, organic sulfonic acids described in Japanese Patent Application (OPI) No. 97347/81, Japanese Patent Publication No. 39359/81, and West German Patent 2,227,639, phosphonocarboxylic acids described in Japanese Patent Application (OPI) Nos. 102726/77, 42730/78, 121127/79, 126241/80 and 65956/80, and the compounds described in Japanese Patent Application (OPI) Nos. 195845/83, 203440/83 and Japanese Patent Publication No. 40900/78.

Specific examples of the chelating agent are illustrated below, but the invention is not limited to these compounds.

Nitrilotriacetic acid,
Diethylenetriaminepentaacetic acid,
Ethylenediaminetetraacetic acid,
Triethylenetetraminehexaacetic acid,
N,N,N-trimethylenephosphonic acid,
Ethylenediamine-N,N,N',N'-tetramethylenephosphonic acid,
1,3-diamino-2-propanol-tetraacetic acid,
Transcyclohexanediaminetetraacetic acid,
Nitrilotripropionic acid,
1,2-diaminopropanetetraacetic acid,
Hydroxyethyliminodiacetic acid,
Glycol ether diaminetetraacetic acid,
Hydroxyethylenediaminetriacetic acid,
Ethylenediamineorthohydroxyphenylacetic acid,
2-phosphonobutane-1,2,4-tricarbonic acid,
1-hydroxyethylidene-1,1-diphosphonic acid,
N,N-bis(2-hydroxybenzyl)ethylenediamine-N,N'-diacetic acid.

These chelating agents may be used, if desired, as a mixture thereof.

The amount of the chelating agent may be one sufficient for masking metal ions in the color developer, and is generally from about 0.1 g to about 10 g per liter of the color developer.

Moreover, the color developer for use in this invention may further contain, if desired, development accelerators.

Examples of the development accelerator are thioether compounds described in Japanese Patent Publication Nos. 16088/62, 5987/62, 7826/63, 12380/69 and 9019/70, and U.S. Patent 3,813,247, p-phenylenediamine compounds described in Japanese Patent Application (OPI) Nos. 49829/77 and 15554/75, quaternary ammonium salts described in Japanese Patent Application (OPI) Nos. 137726/75, 156826/81 and 43429/77, and Japanese Patent Publication No. 30074/69, p-aminophenols described in U.S. Pat. Nos. 2,610,122 and 4,119,462, amine compounds described in U.S. Pat. Nos. 2,494,903, 3,128,182, 4,230,796 and 3,253,919, Japanese Patent Publication No. 11431/66, U.S. Pat. Nos. 2,482,546, 2,596,926 and 3,582,346, polyalkylene oxides described in Japanese Patent Publication Nos. 16088/62, 25201/67, 11431/66 and 23883/67, U.S. Pat. Nos. 3,128,183 and 3,532,501, and also 1-phenyl-3-pyrazolidones, hydrazines, mesoion-type compounds, ion-type compounds, imidazoles, etc.

Also, the color developer for use in this invention may further contain, if desired, optional antifoggants. As the antifoggants, there are metal halides such as sodium chloride, potassium bromide, potassium iodide, etc., and organic antifoggants. Examples of the organic antifoggant include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-triazolylbenzimidazole, 2-thiazolylmethyl-benzimidazole, indazoles, hydroxyazaindolizineadenine, etc.

Furthermore, the color developer for use in this invention preferably contains a brightening agent. Preferred examples of the brightening agent are 4'-diamino2,2'-disulfostilbene-series compounds. The addition amount of the brightening agent is from 0 to 5 g, and preferably from 0.1 g to 4 g per liter of the color developer.

Still further, the color developer for use in this invention may further contain, if desired, various kinds of surface active agents such as alkylsulfonic acids, arylphosphonic acids, aliphatic carboxylic acids, aromatic carboxylic acids, etc.

The processing temperature for the color developer in this invention is from 20° C. to 50° C., and preferably from 30° C. to 40° C. The processing time is from 20 seconds to 5 minutes, and preferably from 30 seconds to 2 minutes. The amount of the replenisher for the color developer is desirably as small as possible, but is usually from 20 to 600 ml, preferably from 50 to 300 ml, and more preferably from 100 to 200 ml per square meter of color photographic material.

Next, a bleach solution and a fix solution or a bleach-fix (blix) solution which are used in the processing process of this invention are explained.

As the bleaching agent which is used for the bleach solution or the blix solution in this invention, any bleaching agents may be used but organic complex salts of iron(III) (e.g., the complex salts of aminopolycarboxylic acids such as ethylenediaminetetraacetic acid, diethylenetriaminepentaacetic acid, etc., and organic phosphonic acids such as aminopolyphosphonic acid, phosphonocarboxylic acid, etc.); organic acids such as citric acid, tartaric acid, malic acid, etc.; persulfates; hydrogenperoxides, etc. In these compounds, organic complex salts of iron(III) are preferred from the viewpoint of quick processing and the prevention of environmental pollution.

Examples of aminopolycarboxylic acids, aminopolyphosphonic acids or organic phosphonic acids useful for forming the organic complex salts of iron(III) are ethylenediaminetetraacetic acid, diethyltriaminepentaacetic acid, ethylenediamine-N-(β-oxyethyl)-N,N',N'-triacetic acid, 1,3-diaminopropanetetraacetic acid, triethylenetetraminehexaacetic acid, propylenediaminetetraacetic acid, nitrilotriacetic acid, nitrilotripropionic acid, cyclohexanediaminetetraacetic acid, 1,3-diamino-2-propanoltetraacetic acid, methyliminodiacetic acid, iminodiacetic acid, hydroxyliminodiacetic acid, dihydroxyethylglycine ethyl ether diaminotetraacetic acid, glycol ether diaminetetraacetic acid, ethylenediaminetetrapropionic acid, ethylenediaminedipropionic acid, phenylenediaminetetraacetic acid, 2-phosphonobutane-1,2,4-triacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, 1-hydroxyethylidene-1,1-diphosphonic acid, etc.

These compounds may be in the form of the sodium salts, potassium salts, lithium salts, or ammonium salts thereof. In these compounds, the iron(III) complex salts of ethylenediaminetetraacetic acid, diethylenetriaminepentaacetic acid, cyclohexanediaminotetraacetic acid, 1,3-diaminopropanetetraacetic acid, and methyliminodiacetic acid are preferred due to their high bleaching power.

These ferric ion complex salts may be used in the form of the complex salts or may be formed in a solution using ferric salts such as ferric sulfate, ferric chloride, ferric nitrate, ferric ammonium sulfate, ferric phosphate, etc., and a chelating agent such as aminopolycarboxylic acid, aminopolyphosphonic acid, phosphonocarboxylic acid, etc. In the case of use in the form of a complex salt, the complex salts may be used singly or as a mixture thereof. Furthermore, in the case of forming a complex salt in a solution using ferric salts and a chelating agent, the ferric salts may be used singly or as a mixture thereof and the chelating agents may be used singly or as a mixture thereof.

In any case, the chelating agent(s) may be used in an excessive amount to that of forming the ferric ion complex salt. In these ferric complex salts, the aminopolycarboxylic acid iron complex salts are preferred and the addition amount thereof is from 0.01 mol to 1.0 mol, and preferably from 0.05 mol to 0.50 mol per liter of the bleach solution or blix solution.

Also, the bleach solution or blix solution may further contain, if desired, a bleach accelerator. Specific examples of useful bleach accelerators are compounds having a mercapto group or a disulfide group described in U.S. Patent 3,893,858, West German Patents 1,290,812 and 2,059,988, Japanese Patent Application (OPI) Nos. 32736/78, 57831/78, 37418/78, 65723/78, 72623/78, 95630/78, 95631/78, 104232/78, 124424/78, 141623/78, 28426/78, *Research Disclosure*, No. 17129 (June, 1978), etc., thiazolidine derivatives described in Japanese Patent Application (OPI) No. 140129/75, thiourea derivatives described in Japanese Patent Publication No. 8506/70, Japanese Patent Application (OPI) Nos. 20832/77 and 32735/78, and U.S. Pat. No. 3,706,651, iodides described in West German Patent 1,127,715 and Japanese Patent Application (OPI) No. 16235/83, polyethylene oxides described in West German Pat. Nos. 966,410 and 2,748,430, polyamine compounds described in Japanese Patent Publication No. 8836/70, the compounds described in Japanese Patent Application (OPI) Nos. 42434/74, 59644/74, 94927/78, 35727/79, 26506/80 and 163940/83, and iodine ions, bromine ions, etc.

Of these compounds, the compounds having a mercapto group or a disulfide group are preferred from the viewpoint of showing a large acceleration effect and further the compounds described in U.S. Pat. No. 3,893,858, West German Pat. No. 1,290,812, and Japanese Patent Application (OPI) No. 95630/78 are preferred.

The bleach solution or blix solution for use in this invention may further contain a rehalogenating agent such as a bromide (e.g., potassium bromide, sodium bromide, ammonium bromide, etc.), a chloride (e.g., potassium chloride, sodium chloride, ammonium chloride, etc.) and an iodide (e.g., ammonium iodide, etc.). Furthermore, if desired, the bleach solution or blix solution may further contain a corrosion inhibitor such as inorganic or organic acids having a pH buffer action and the alkali metal salts and ammonium salts thereof (e.g., boric acid, borax, sodium metaborate, acetic acid, sodium acetate, sodium carbonate, potassium carbonate, phosphorous acid, sodium phosphate, citric acid, sodium citrate, tartaric acid, etc.), ammonium nitrate, guanidine, etc.

As a fixing agent which is used for the blix solution or the fix solution in this invention, there are thiosulfates such as sodium thiosulfate, ammonium thiosulfate, etc., thiocyanates such as sodium thiocyanate, ammonium thiocyanate, etc., thioether compounds such as ethylenebisthioglycolic acid, 3,6-dithia-1,8-octanediol, etc., and water-soluble silver halide solvents such as thioureas, etc., which are known fixing agents.

They may be used singly or as a mixture thereof.

Also, a specific blix solution composed of a combination of a fixing agent as a large amount of halide such as potassium iodide, etc., described in Japanese Patent Application (OPI) No. 155354/80 can be used in this invention. In this invention, the use of a thiosulfates is preferred, and the use of ammonium thiosulfate is particularly preferred.

The amount of the fixing agent is preferably from 0.3 mol to 2 mols, and more preferably from 0.5 mol to 1.0 mol per liter of the fix solution or blix solution.

The pH range of the blix solution or fix solution for use in this invention is preferably from 3 to 10, and more preferably from 5 to 9. If the pH is lower than 3, the desilvering property may be improved but the deterioration of the solution and the formation of leuco compounds from cyan dyes are undesirably accelerated. If the pH is higher than 10, the desilvering is delayed and stain is liable to form.

For controlling the pH of the solution, hydrochloric acid, sulfuric acid, nitric acid, acetic acid, a hydrogencarbonate, ammonia, potassium hydroxide, sodium hydroxide, sodium carbonate, potassium carbonate, etc., may be added, if desired, to the blix solution or fix solution.

Also, the blix solution for use in this invention may further contain various kinds of brightening agents, defoaming agents, surface active agents and organic solvents such as polyvinylpyrrolidone, methanol, etc.

The blix solution or fix solution for use in this invention may further contain a sulfite ion releasing compound such as a sulfite (e.g., sodium sulfite, potassium sulfite, ammonium sulfite, etc.), a bisulfite (e.g., ammonium bisulfite, sodium bisulfite, potassium bisulfite, etc.), a metasulfite (e.g., potassium metasulfite, ammonium metasulfite, sodium metasulfite, etc.), etc., as a preservative. The addition amount of the compound is preferably from about 0.20 mol to about 0.50 mol, and more preferably from about 0.04 mol to 0.40 mol per liter of the solution.

As the preservative, the sulfite as described above is generally used but ascorbic acid, a carbonylbisulfite adduct, or a carbon compound may be added as a preservative.

Furthermore, the blix solution or fix solution may contain, if desired, a buffer, a brightening agent, a chelating agent, an antifungal agent, etc.

Next, the wash step in this invention is explained. In this invention, a simple processing process of employing a so-called "stabilization process" without substantially employing a wash step may be used in place of performing ordinary "wash processing". Thus, the "wash process" in this invention has a broad meaning.

It is difficult to define the amount of wash water since the amount differs according to the number of baths for multistage countercurrent washing and the amount of the composition of a pre-bath carried by light-sensitive material. But in this invention, the content of a blix solution component or fix solution component in a final wash bath may be less than about $1\times10^{-4}$ mol/l.

For example, in the case of a 3 tank countercurrent wash, it is preferred to use more than about 1,000 ml, particularly, more than about 5,000 ml of water per square meter of light-sensitive material. Also, in the case of water-saving processing, it is preferred to use from 100 ml to 1,000 ml of water per square meter of light-sensitive material.

The wash water temperature is preferably from 15° C. to 45° C., and more preferably from 20° C. to 35° C.

The water for the wash step may contain various known compounds for the purposes of precipitation prevention and stabilization of the wash water. For example, chelating agents such as inorganic phosphoric acid, aminopolycarboxylic acid, organic phosphonic acid, etc., antibacterial agents or antifungal agents for preventing the generation of bacteria, algae, and molds, such as the compounds described in *Journal of Antibacterial and Antifungal Agents*, Vol. 11, No. 5, 207–223 (1983) and the compounds described in Hiroshi Horiguchi, *Bokin Bobai no Kagaku* (*Antibacterial and Antifungal Chemistry*), metal salts such as magnesium salts and aluminum salts, alkali metal salts, ammonium salts, surface active agents for preventing the occurrence of uneven processing and reducing drying load, etc., can be, if necessary, added to wash water. Furthermore, the compounds described in West, *Photographic Science Engineering*, Vol. 6, 344–359 (1965) may be added to the wash water.

Furthermore, in the case of adding a chelating agent, and antibacterial and antifungal agents to the wash water and greatly saving the amount of wash water by employing multistage countercurrent washing by two or more tanks, the invention is particularly effective. Also, in the case of employing a multistage countercurrent stabilization process step (so-called stabilization process) as described in Japanese Patent Application (OPI) No. 8543/82 in place of an ordinary wash step, the invention is particularly effective. In these cases, the content of the blix component or fix component in the final bath or tank may be less than $5\times10^{-2}$ mol/l, preferably less than $1\times10^{-2}$ mol/l.

The stabilization bath for use in this invention contains various compounds for stabilizing color images formed. For example, there are various buffers (e.g., a proper combination of borates, metaborates, borax, phosphates, carbonates, potassium hydroxide, sodium hydroxide, aqueous ammonia, monocarboxylic acid, dicarboxylic acid, polycarboxylic acid, etc.), formalin, and aldehydes for controlling the pH of photographic layers (e.g., pH 3 to 8). Other examples of additives which can be added thereto are chelating agents (e.g., inorganic phosphoric acid, aminopolycarboxylic acid, organic phosphonic acid, aminopolyphosphonic acid, phosphonocarboxylic acid, etc.), antibacterial agents (e.g., thiazole-series agents, isothiazole-series agent, halogenated phenol, sulfanilamide, benzotriazole, etc.), surface active agents, brightening agents, hardening agents, etc. They may be used as a combination of two or more of the same or different kinds of compounds.

Also, it is preferred for improving the storage stability of color images formed to add an ammonium salt such as ammonium chloride, ammonium nitrate, ammonium sulfate, ammonium phosphate, ammonium sulfite, ammonium thiosulfate, etc., to the stabilization bath as a pH controlling agent for photographic layers.

In the case of greatly saving the amount of wash water as described above, it is preferred for reducing the amount of waste water to supply a part or the whole amount of the overflow solution of wash water to the blix bath or fix bath, which is a pre-bath.

In continuous processing of the processing process of this invention, a constant finish is obtained by preventing the deviation of the composition of each processing solution using a replenisher for each processing solution. The amount of each replenisher can be reduced to half or less than half of a standard replenisher amount for cost reduction, etc.

In this invention, each processing bath or tank may, if desired, be equipped with a heater, a temperature sensor, a solution level sensor, a circulation pump, a filter, various kinds of floating lids, various kinds of squeegees, nitrogen stirrer, air stirrer, etc.

The process of this invention can be applied to any types of processing using a color developer. For example, the process of this invention can be applied for processing color photographic papers, color photographic reversal papers, color photographic positive films, color photographic negative films, color photographic reversal films, etc.

As silver halide emulsions of color photographic materials to which the processing process of this invention is applied, silver iodobromide emulsions, silver bromide emulsions, silver chlorobromide emulsions, silver chloride emulsions, etc., can be used, but in the case of performing quick processing or low-replenisher processing, the use of a silver chlorobromide emulsion containing at least 60 mol % silver chloride or a silver chloride emulsion is preferred and further the use of the emulsion containing from 80 to 100 mol % silver chloride is particularly preferred. Also, in the case of requiring high sensitivity and keeping the formation of fog as low as possible during the production, storage, and/or processing of color photographic materials, a silver chlorobromide emulsion containing at least 50 mol % silver bromide or a silver bromide emulsion is preferred and also it is more preferred in the former case that the content of silver bromide is higher than 70 mol %. When the content of silver bromide is over 90 mol %, it becomes difficult to effectively perform quick processing for the color photographic materials, but by employing a development accelerating means of using a development accelerator such as a silver halide solvent, a fogging agent, a developing agent, etc., as will be described hereinafter, the development process can be quickened to some extent without being restricted by the content of silver bromide and such a case is sometimes preferred. In any case, it is not preferred that the silver halide emulsion contains a large amount of silver iodide and it is better than the content of silver iodide is less than 3 mol %.

The silver halide grains of the silver halide emulsions for use in this invention may have different phases between the inside and the surface layer thereof, may be a multiphase structure having a junction structure, or may be composed of a uniform phase throughout the whole grain. Also, the silver halide grains may be composed of a mixture of the aforesaid various grains.

The mean grain size (shown by the mean value based on the projected area using the diameter of the grains when the grain is spherical or similar to spherical, and shown by the mean value based on the projected area using, in the case of cubic grains, the long side length as the grain size, or shown by the mean value based on the projected area using the diameter calculated as a sphere in the case of tabular grains) of the silver halide grains in this invention is preferably in the range of from 0.1 μm to 2 μm, and more preferably from 0.15 μm to 1.5 μm. The grain size distribution of the silver halide grains may be narrow or broad but the use of a so-called monodisperse silver halide emulsion, wherein the value (coefficient of variation) obtained by dividing the standard deviation in the grain size distribution curve of the silver halide emulsion by the mean grain size of the silver halide grains in the emulsion is within 20% (particularly preferably within 15%), is preferred. Also, for satisfying the desired gradation for the color photographic materials, two or more kinds of monodisperse silver halide emulsions (preferably having the abovedescribed coefficient of variation) each having a different grain size can be used as a mixture thereof for one emulsion layer or as separate emulsion layers each having substantially the same color sensitivity. Furthermore, two or more kinds of polydisperse silver halide emulsion layers or a combination of the monodisperse emulsion layer and a polydisperse silver halide emulsion can be used as a mixture thereof for one emulsion layer or as separate emulsion layers.

The silver halide grains for use in this invention may have a regular crystal form such as cubic, octahedral, dodecahedral, tetradecahedral, etc., a mixture thereof, an irregular crystal form such as spherical, etc., or a composite form of these crystal forms. Also, the silver halide grains may be tabular grains and in this case, a tabular grain silver halide emulsion wherein tabular silver halide grains having an aspect ratio (length/thickness) of at least 5, and particularly at least 8, account for at least 50% of the total projected area of the silver halide grains can be used in this invention. A mixture of these silver halide emulsions each containing silver halide grains having different crystal forms may also be used. The silver halide emulsion may be of a surface latent image type of forming latent images mainly on the surface thereof or of an internal latent image type of forming latent images mainly in the inside of the grains.

The silver halide photographic emulsions for use in this invention can be prepared according to the methods described in P. Glafkides, *Chimie et Physique Photographique*, published by Paul Montel, 1967; G. F. Duffin, *Photographic Emulsion Chemistry*, published by Focal Press (1966); and V. L. Zelikman et al., *Making and Coating Photographic Emulsion*, published by Focal Press (1964).

That is, the emulsion can be prepared by an acid method, a neutral method, an ammonia method, etc., and as a method of reacting a soluble silver salt and a soluble halide, a single jet method, a double jet method, or a combination thereof may be employed. A so-called reverse mixing method of forming silver halide grains in the pressure of excess silver ions can be also used. As one system of the double jet method, a so-called controlled double jet method of keeping a constant pAg in a liquid phase of forming silver halide grains can be also used. According to the method, a silver halide emulsion containing silver halide grains having a regular crystal form and substantially uniform grain sizes can be obtained.

Furthermore, a silver halide emulsion prepared by a so-called conversion method including a step of converting a silver halide already formed before finishing the formation of the silver halide grains into a silver halid having a small solubility product or a silver halide emulsion to which the similar halogen conversion is applied after finishing the formation of the silver halide grain can also be used in this invention.

During the formation or physical ripening of the silver halide grains, a cadmium salt, a zinc salt, a lead salt, a copper salt, a thallium salt, an iridium salt or the complex salt thereof, a rhodium salt or the complex salt thereof, an iron salt or the complex salt thereof, etc., may exist in the system.

Silver halide emulsions are, after the formation of the silver halide grains, usually physically ripened, desalted, and chemically ripened before coating.

A known silver halide solvent (e.g., ammonia, potassium rhodanate, and thioethers and thione compound scribed in U.S. Pat. No. 3,271,157, Japanese Patent Application (OPI) Nos. 12360/76, 82408/78, 144319/78, 100717 155828/79, etc.) can be used for the precipitation, physical ripening, and chemical ripening of the silver halide emulsions for use in this invention.

For removing soluble salts from silver halide emulsions after physical ripening, a noodle washing method, a flocculation method, or an ultrafiltration method can be employed.

The silver halide emulsions for use in this invention can be chemically sensitized by a sulfur sensitization method using active gelatin or a sulfur-containing compound capable of reacting with silver (e.g., thiosulfate, thioureas, mercapto compounds, rhodanines, etc.); a reduction sensitization method using a reducing substance (e.g., stannous salts, amines, hydrazine derivatives, formamidinesulfinic acid, silane compounds, etc.); a noble metal sensitization method using a metal compound (e.g., gold complex salts and complex salts of metals belonging to group VIII of the Periodic Table, such as Pt, Ir, Pd, Rh, Fe, etc.), or a combination thereof.

The blue-sensitive, green-sensitive, and red-sensitive emulsions each is the silver halide emulsion which has been spectrally sensitized by a methine dye, etc. so as to exhibit a desired color sensitivity. The dyes for use include cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to cyanine dyes, merocyanine dyes, and complex merocyanine dyes.

For these dyes can be applied nuclei ordinarily utilized for cyanine dyes as basic heterocyclic nuclei. That is, there are pyrroline nuclei, oxazoline nuclei, thiazoline nuclei, pyrrole nuclei, oxazole nuclei, thiazole nuclei, pyridine nuclei, etc.; the nuclei formed by fusing an aliphatic hydrocarbon ring to the aforesaid nuclei, and the nuclei formed by fusing an aromatic hydrocarbon ring to the aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

For merocyanine dyes or complex merocyanine dyes may be applied 5-membered or 6-membered heterocyclic nuclei such as pyrazolin-5-one nuclei, thiohydantoin nuclei, 2-triooxazolidine-2,4-dione nuclei, thiazolidine-2,4-dione nuclei, rhodanine nuclei, thiobarbituric acid nuclei, etc., as a nucleus having a ketomethylene structure.

These sensitizing dyes may be used singly or as a combination thereof. A combination of sensitizing dyes is frequently used for the purpose of supersensitization. Typical examples of the combinations are described in U.S. Pat. Nos. 2,688,545, 2,977,229, 2,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77, 109925/77, etc.

The silver halide emulsion for use in this invention may contains a dye having no spectral sensitizing activity by itself or a substance which does not substantially absorb visible light and shows supersensitizing activity together with the sensitizing dye(s).

The sensitizing dye(s) may be added to a silver halide emulsion in any step during the formation of silver halide grains, before or after the chemical sensitization, during the chemical sensitization, or coating. The addition of the sensitizing dye(s) during the formation of silver halide grains is effective not only for increase of adsorption thereof but also for control of the crystal form and the structure in the grains. Also, the addition of the sensitizing dye(s) at chemical sensitization is effective not only for the increase of the adsorption thereof but also for control of the chemical sensitizing site and prevention of the deformation of crystals. Such an addition method is particularly effective in the case of using silver halide emulsions having a high content of silver chloride and also in the case of using silver halide emulsions having a high silver bromide content or silver iodide content at the surface of the silver halide grains.

Color photographic materials for use in this invention contain color couplers in the silver halide emulsion layers thereof. It is preferred that the color couplers are rendered nondiffusible by having a ballast group or by being polymerized. The use of 2-equivalent color couplers the coupling active position of which is substituted by a releasing group is more effective for reducing the amount of silver than the case of using 4-equivalent color couplers having a hydrogen atom at the coupling active position thereof. Couplers providing colored dyes having a proper diffusibility, colorless compound forming couplers, DIR couplers releasing a development inhibitor with the coupling reaction, or couplers releasing a development accelerator with the coupling reaction thereof can be used for the color photographic materials in this invention.

Typical examples of the yellow couplers for use in this invention are oil-protect type acylacetamide-series yellow couplers. Specific examples of the couplers are described in U.S. Pat. Nos. 2,407,210, 2,875,057, 3,265,506, etc.

In this invention, 2-equivalent yellow couplers are preferably used and typical examples thereof are yellow couplers having oxygen atom-linked coupling-off groups described in U.S. Pat. Nos. 3,408,194, 3,447,928, 3,933,501, 4,022,620, etc., and yellow couplers having nitrogen atom-linked coupling-off groups described in Japanese Patent Publication No. 10739/83, U.S. Pat. Nos. 4,401,752 and 4,326,024, *Research Disclosure*, RD No. 18053 (April, 1979), British Pat. No. 1,425,202, West German Patent Application (OLS) Nos. 2,219,917, 2,261,361, 2,329,587, 2,433,812, etc. In these couplers, α-pivaloylacetanilide-series yellow couplers are excellent in fastness, particularly in light fastness, while α-benzoylacetanilide-series yellow couplers give high color density.

As the magenta couplers for use in this invention, there are oil-protect-type indazolone-series or cyanoacetyl-series magenta couplers, preferably 5-pyrazolone-series couplers and pyrazoloazole-series couplers such as pyrazolotriazole-series couplers. The 5-pyrazolone-series couplers having an arylamino group or an acylamino group at the 3-position thereof are preferred from the standpoint of the hue of the colored dyes and the color density. Typical examples of these couplers are described in U.S. Pat. Nos. 2,311,082, 2,343,703, 2,600,788, 2,908,573, 3,062,653, 3,152,896, 2,936,015, etc. Preferred releasing groups for the 2-equivalent 5-pyrazolone-series magenta couplers include nitrogen atom-linked coupling-off groups described in U.S. Pat. No. 4,310,619 and arylthio groups described in U.S. Pat. No. 4,351,897. Also, 5-pyrazolone-series magenta couplers having a ballast group described in European Pat. No. 73,636 give high color density.

Pyrazoloazole-series magenta couplers include pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in Research Disclosure, RD No. 24220 (June, 1984), and pyrazolopyrazoles described in *Research Disclosure*, RD No. 24230 (June, 1984). From the viewpoint of less yellow side-absorption of colored dyes and high light fastness of colored dyes, imidazo[1,2-b]pyrazoles described in European Patent 119,741 are preferred and pyrazolo[1,5-b][1,2,4]triazoles described in European Pat. No. 119,860 are particularly preferred.

Cyan couplers for use in this invention include oil-protect-type naphtholic and phenolic couplers.

Typical examples of the naphtholic cyan couplers are naphtholic couplers described in U.S. Pat. No. 2,474,293, preferably 2-equivalent naphtholic couplers having oxygen atom-linked coupling-off groups described in U.S. Pat. Nos. 4,052,212, 4,146,396, 4,228,233 and 4,296,200. Also, specific examples of the phenolic cyan couplers are described in U.S. Pat. Nos. 2,369,929, 2,801,171, 2,772,162, 2,895,826, etc. Cyan couplers having high fastness to moisture and heat are preferably used in this invention, and typical examples thereof are the phenolic cyan couplers having an alkyl group having two or more carbon atoms at the metaposition of the phenol nucleus described in U.S. Pat. No. 3,772,002, 2,5-diacylamino-substituted phenolic cyan couplers described in U.S. Pat. Nos. 2,772,162, 3,758,308, 4,126,396, 4,334,011 and 4,327,173, West German Pat. Application (OLS) No. 3,329,729, Japanese Patent Application No. 42671/83 (corresponding to Japanese Patent Application (OPI) No. 166956/84), etc., and phenolic cyan couplers having a phenylureido group at the 2-position and an acylamino group at the 5-position thereof described in U.S. Pat. Nos. 3,446,622, 4,333,999, 4,451,559, 4,427,767, etc.

In this invention, the graininess of the color images formed can be improved by using a coupler giving colored dye having a proper diffusibility together with the above-described coupler(s). As to such couplers giving the properly diffusible dyes, specific examples of the magenta couplers are described in U.S. Pat. No. 4,366,237 and specific examples of the yellow, magenta, and cyan couplers are described in European Patent No. 96,570 and West German Patent Application (OLS) No. 3,234,533.

The dye-forming couplers and the specific couplers described above may form a dimer or higher polymer. Typical examples of the polymerized dye-forming couplers are described in U.S. Pat. Nos. 3,451,820 and 4,080,211. Also, specific examples of the polymerized magenta couplers are described in British Patent No. 2,102,173 and U.S. Pat. No. 4,367,282.

The couplers for use in this invention can be used for one light-sensitive emulsion layer as a mixture of two or more thereof, or the same kind of the coupler may exist in two or more light-sensitive emulsion layers for meeting the properties required for the color photographic material.

The couplers for use in this invention can be introduced into silver halide emulsions by an oil drop-in-water dispersion method. That is, the coupler is dissolved in a high-boiling organic solvent having a boiling point of at least 175° C. or a low-boiling so-called auxiliary solvent, or a mixture of both types of solvents, and then finely dispersed in water or an aqueous medium such as an aqueous gelatin solution in the presence of a surface active agent. Examples of the high-boiling organic solvent are described in U.S. Pat. No. 2,322,027, etc. In this case, the coupler may be dispersed with phase inversion and also, if necessary, the auxiliary solvent may be removed by distillation, noodle washing, or ultrafiltration before coating the dispersion.

Specific examples of the high-boiling organic solvent are phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2-ethylhexyldiphenyl phosphate, tricyclohexyl phosphate, tri2-ethylhexyl phosphate, tridodecyl phosphate, tributoxyethyl phosphate, trichloropropyl phosphate, di-2-ethylhexylphenyl phosphate, etc.), benzoic acid esters (e.g., 2-ethylhexyl benzoate, dodecyl benzoate, 2-ethylhexyl-p-hydroxy benzoate, etc.), amides (e.g., diethyldodecylamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

Also, as the auxiliary solvent, an organic solvent having a boiling point of at least about 30° C., preferably from about 50° C. to about 160° C. can be used, and specific examples thereof are ethyl acetate, butyl acetate, ethyl propionate, methyl ethyl ketone, cyclohexanone, 2-ethoxyethyl acetate, dimethylformamide, etc.

A latex dispersing method can also be applied for incorporating the coupler(s) into silver halide emulsions. The process and effect of the latex dispersing method and specific examples of the latex for impregnation are described in U.S. Pat. No. 4,199,363, West German Patent Application (OLS) Nos. 2,541,274, 2,541,230, etc.

A standard amount of the color coupler is in the range of from 0.001 mol to 1 mol of the light-sensitive silver halide in the silver halide emulsion layer, with from 0.01 mol to 0.5 mol of a yellow coupler, from 0.003 mol to 0.3 mol of a magenta coupler, and from 0.002 mol to 0.3 mol of a cyan coupler, per mol of the light-sensitive silver halide being preferred.

The color photographic materials for use in this invention may further contain hydroquinone derivatives, aminophenol derivatives, amines, gallic acid derivatives, catechol derivatives, ascorbic acid derivatives, colorless compound-forming couplers, sulfonamidophenol derivatives, etc., as color fog preventing agents or color mixing preventing agents.

Also, the color photographic materials for use in this invention can further contain fading preventing agents. Typical examples of organic fading preventing agents are hydroquinones, 6-hydroxychromans, 5-hydroxycoumarans, spirochromans, p-alkoxyphenols, bisphenols, hindered phenols, gallic acid derivatives, methylenedioxybenzenes, aminophenols, hindered amines, and the ether or ester derivatives of the aforesaid compounds obtained by silylating or alkylating the phenolic hydroxy group of these compounds. Also, metal complexes such as (bissalicylaldoxymate) nickel complex salt and (bis-N,N-dialkyldithiocarbamate) nickel complex salt can also be used as the fading preventing agent.

For preventing the deterioration of yellow dye images by heat, moisture, and light, the compound having both moieties of a hindered amine and a hindered phenol in one molecule as described in U.S. Pat. No. 4,268,593 gives good results. Also, for preventing the deterioration of magenta dye images, particularly by light, spiroindans described in Japanese Patent Application (OPI) No. 159644/81 and chromans substituted by hydroquinone diether or hydroquinone monoether described in Japanese Patent Application (OPI) No. 89835/80 give preferred results.

For improving the storage stability, in particular, the light fastness of cyan dye images, it is preferred to use a benzotriazole-series ultraviolet absorbent with the cyan coupler(s). The ultraviolet absorbent may be coemulsified with the cyan coupler(s).

The ultraviolet absorbent is desirably used in an amount sufficient for imparting light stability to cyan dye images, but since if the amount is too much, the unexposed portions (background portions) of the color photographic material are sometimes yellowed, the amount thereof is usually selected in the range of from $1\times10^{-4}$ mol/m$^2$ to $2\times10^{-3}$ mol/m$^2$, and particularly from $5\times10^{-4}$ mol/m$^2$ to $1.5\times10^{-3}$ mol/m$^2$.

In the layer structure of an ordinary color photographic paper, the ultraviolet absorbent(s) are incorporated in one or both layers adjacent to both sides of a red-sensitive silver halide emulsion layer containing a cyan coupler. When the ultraviolet absorbent(s) are incorporated in the interlayer between a green-sensitive emulsion layer and a red-sensitive emulsion layer, the ultraviolet absorbent(s) may be emulsified together with a color mixing preventing agent. When the ultraviolet absorbent(s) are incorporated in a protective layer, another protective layer may be formed on the protective layer as the outermost layer. The outermost protective layer may contain a matting agent having a proper particle size.

The color photographic materials in this invention may contain the ultraviolet absorbent(s) in the hydrophilic colloid layer.

The color photographic materials in this invention may further contain water-soluble dyes in the hydrophilic colloid layers as filter dyes or for the purpose of irradiation prevention or halation prevention. As such water-soluble dyes, oxonol-series dyes, anthraquinone-series dyes, and azo-series dyes are preferred. Oxonol dyes showing absorption for green light and red light are particularly preferred.

The color photographic materials for use in this invention may further contain whitening agents such as stilbene-series, triazine-series, oxazole-series, or coumarin-series whitening agents in the photographic emulsion layers or other hydrophilic colloid layers. The whitening agent may be water-soluble or a water-insoluble whitening agent may be used as the form of the dispersion thereof.

The process of this invention can be applied to a multilayer multicolor photographic material having at least two photographic emulsion layers each having different spectral sensitivity on a support. A multilayer natural color photographic material usually has at least one red-sensitive emulsion layer, at least one green-sensitive emulsion layer, and at least one blue-sensitive emulsion layer on a support. The order of the emulsion layers can be optionally selected according to the purposes. Also, each of the aforesaid emulsion layers may be composed of two or more emulsion layers each having different sensitivity or a light-insensitive layer may exist between two or more emulsion layers each having the same sensitivity.

The color photographic material for use in this invention preferably has auxiliary layers such as protective layer(s), interlayers, a filter layer, an antihalation layer, a back layer, etc., in addition to the silver halide emulsion layers.

As a binder or protective colloid which can be used for the emulsion layers and auxiliary layers of the color photographic materials for use in this invention, gelatin is advantageously used but other hydrophilic colloids may also be used.

Examples of the protective colloid are proteins such as gelatin derivatives, graft polymers of gelatin and other polymers, albumin, casein, etc.; cellulose derivatives such as hydroxyethyl cellulose, carboxymethyl cellulose, cellulose sulfuric acid ester, etc.; saccharose derivatives such as sodium alginate, starch derivatives, etc.; and synthetic hydrophilic homo- or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

The use of acrylic acid-modified polyvinyl alcohol is particularly useful for protective layers and is more particularly useful for protective layers in the case of quick processing color photographic materials using high silver chloride-containing silver halide emulsions.

As gelatin, lime-processed gelatin as well as acid processed gelatin and enzyme-processed gelatin as described in *Bull. Soc. Sci. Phot. Japan*, No. 16, p. 30 (1966) can be used. Furthermore, the hydrolyzed product or enzyme-decomposed product of gelatin can be used.

The color photographic materials for use in this invention may further contain various stabilizers, stain preventing agents, developing agents or the precursors thereof, development accelerators or the precursors thereof, lubricants, mordants, matting agents, antistatic agents, plasticizers, or other photographically useful additives in addition to the above-described additives. Typical examples of such additives are described in *Research Disclosure*, RD No. 17643 (December, 1978) and *Research Disclosure*, RD No. 18716 (November, 1979).

These additives are very important in quick printing or quick processing and further are important in the relation with the compounds of the general formula (I) described above for use in this invention. Also, when the silver halide emulsions for use in this invention have a high silver chloride content, it is useful for the coloring property and the reduction of the formation of fog to use mercaptoazole-series, mercaptothiazole-series, or mercaptobenzazole-series compounds for the color photographic materials.

The "reflective support" for the color photographic material which is processed in this invention is a support having high reflectivity for clearly viewing color images formed in silver halide emulsion layer(s) and includes a support coated with a hydrophobic resin having dispersed therein a light reflective substance such as titanium dioxide, zinc oxide, calcium carbonate, calcium sulfate, etc., and a support composed of a hydrophobic resin containing the light reflective substance as described above as a dispersion thereof. Examples of such a support include barytacoated papers, polyethylene-coated papers, polypropylene-series synthetic papers, and transparent supports coated with a reflective layer or containing a reflective substance as described above. Examples of such a transparent support are glass plates, polyester films (e.g., polyethylene terephthalate films, cellulose triacetate films, cellulose nitrate films, etc.), polyamide films, polycarbonate films, polystyrene films, etc. These supports can be properly selected according to the purposes thereof.

The color developer for use in the process of this invention is excellent in stability and coloring property and also the process of this invention can greatly reduce the increase of fog in continuous processing of silver halide color photographic materials.

Also, in the process of this invention, the effect is more improved in the case that the color developer contains substantially no benzyl alcohol.

Furthermore, by using the color developer in this invention, the stability thereof can be improved without the need for using a material acting as a competing compound for a color developing agent, such as sulfite ions and also the deterioration of coloring property can be prevented.

The following examples are intended to illustrate the present invention more practically but not to limit it in any way.

Unless otherwise specified, all ratios, percents, etc. are by weight.

EXAMPLE 1

A multilayer color photographic paper having layers as shown below on a paper support both surfaces of which were coated with polyethylene was prepared. In this case, the polyethylene layer on the emulsion-carrying side of the support contained titanium dioxide as a white pigment and ultramarine blue as a bluish dye.

In addition, coating compositions for the photographic layers were prepared as follows.

Preparation of Coating Composition for Layer 1:

In a mixture of 27.2 ml of ethyl acetate and 7.9 ml of solvent (c) shown below were dissolved 19.1 g of yellow coupler (a) shown below and 4.4 g of dye image stabilizer (b) shown below and the solution was dispersed by emulsification in 185 ml of an aqueous 10% gelatin solution containing 8 ml of 10% sodium dodecylbenzenesulfonate. On the other hand, 90 g of a blue-sensitive silver halide emulsion was prepared by adding a blue-sensitizing dye shown below to a silver chlorobromide emulsion (silver bromide 1.0 mol %, Ag 70 g/kg) in an amount of $5.0\times10^{-4}$ mol per mol of silver chlorobromide. The emulsified dispersion of the coupler prepared above was mixed with the aforesaid silver halide emulsion and the concentration of gelatin was adjusted as shown below to provide a coating composition for Layer 1.

The coating composition for Layer 2 to Layer 7 were prepared in a manner similar to the above-described method.

Also, for each layer was used 1-oxy-3,5-dichlorostriazine sodium salt as a gelatin hardening agent.

The spectral sensitizing dyes used for the emulsion layers were as follows.

Blue-Sensitizing Dye for Blue-Sensitive Emulsion Layer:

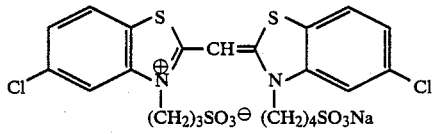

($5.0\times10^{-4}$ mol per mol of silver halide)

Green-Sensitizing Dyes for Green-Sensitive Emulsion Layer:

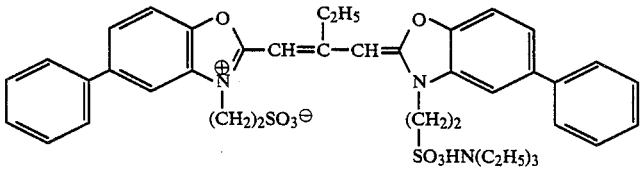

($4.0\times10^{-4}$ per mol of silver halide)

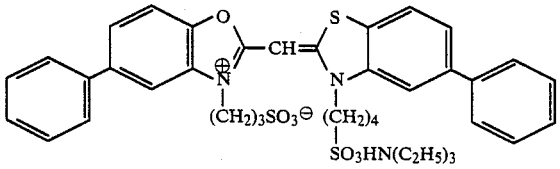

($7.0\times10^{-4}$ mol per mol of silver halide)

Red-Sensitizing Dye for Red-Sensitive Emulsion Layer:

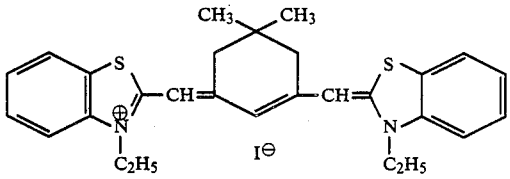

($0.9\times10^{-4}$ mol per mol of silver halide)

In addition, the green-sensitive emulsion layer and the red-sensitive emulsion layer of the color photographic paper each contained an irradiation preventing dye as shown below.

Irradiation Preventing Dye for Green-Sensitive Emulsion Layer:

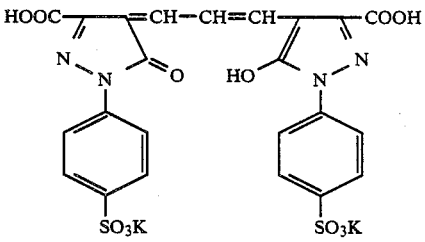

Irradiation Preventing Dye for Red-Sensitive Emulsion Layer:

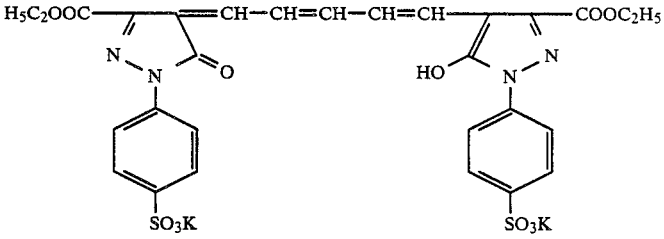

| | | |
|---|---|---|
| Layer 1 | Blue-Sensitive Emulsion Layer | |
| | Silver chlorobromide emulsion (silver bromide 1 mol %) | 0.30 g/m² as silver |
| | Gelatin | 1.86 g/m² |
| | Yellow coupler (a) | 0.82 g/m² |
| | Dye image stabilizer (b) | 0.19 g/m² |
| | Solvent (c) | 0.34 ml/m² |
| Layer 2 | Color Mixing Preventing Layer | |
| | Gelatin | 0.99 g/m² |
| | Color mixing preventing agent (d) | 0.08 g/m² |
| Layer 3 | Green-Sensitive Emulsion Layer | |
| | Silver chlorobromide emulsion (silver bromide 0.5 mol %) | 0.16 g/m² as silver |
| | Gelatin | 1.80 g/m² |
| | Magenta coupler (m) | 0.34 g/m² |

-continued

| | | |
|---|---|---|
| | Dye image stabilizer (f) | 0.20 g/m$^2$ |
| | Solvent (g) | 0.68 ml/m$^2$ |
| Layer 4 | Ultraviolet Absorbing Layer | |
| | Gelatin | 1.60 g/m$^2$ |
| | Ultraviolet absorbent (h) | 0.62 g/m$^2$ |
| | Color mixing preventing agent (i) | 0.05 g/m$^2$ |
| | Solvent (j) | 0.26 ml/m$^2$ |
| Layer 5 | Red-Sensitive Emulsion Layer | |
| | Silver chlorobromide emulsion (silver bromide 1 mol % | 0.26 g/m$^2$ as silver |
| | Gelatin | 0.98 g/m$^2$ |
| | Cyan coupler (k) | 0.38 g/m$^2$ |
| | Dye image stabilizer (l) | 0.17 g/m$^2$ |

-continued

| | | |
|---|---|---|
| | Solvent (e) | 0.23 ml/m$^2$ |
| Layer 6 | Ultraviolet Absorbing Layer | |
| | Gelatin | 0.54 g/m$^2$ |
| | Ultraviolet absorbent (h) | 0.21 g/m$^2$ |
| | Solvent (j) | 0.09 ml/m$^2$ |
| Layer 7 | Protective Layer | |
| | Gelatin | 1.33 g/m$^2$ |
| | Acryl-modified copolymer of polyvinyl alcohol (modification degree 17%) | 0.17 g/m$^2$ |

The couplers, etc., used for the above-described layers of the color photographic paper were as follows:

Yellow Coupler (a)

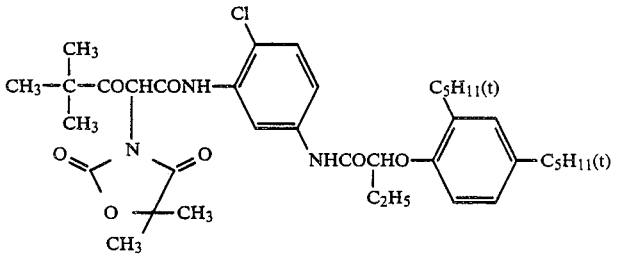

Dye Image Stabilizer (b)

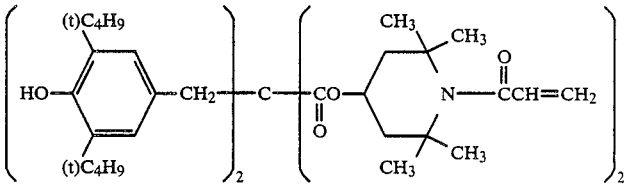

Solvent (c)

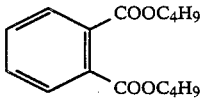

Color Mixing Preventing Agent (d)

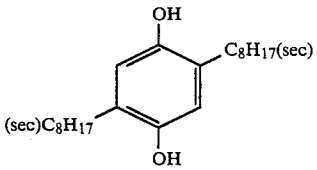

Solvent (e)

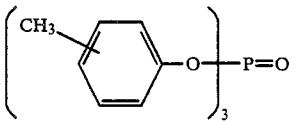

Dye Image Stabilizer (f)

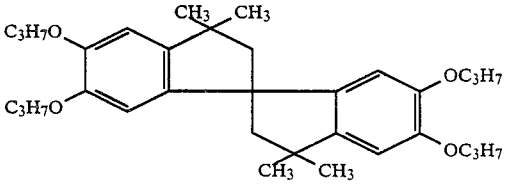

Solvent (g)

-continued
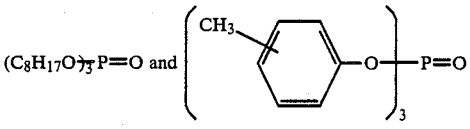
Mixture of 2:1 in weight ratio.
Ultraviolet Absorbent (h)
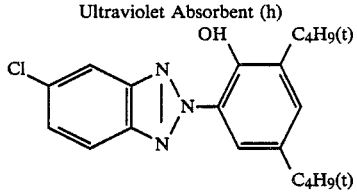
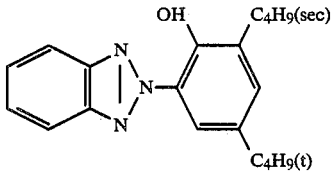
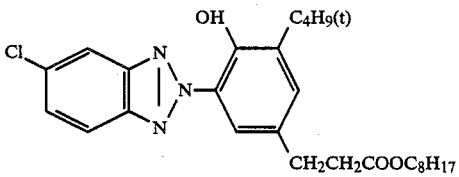
Mixture of 1:5:3 in mol ratio
Color Mixing Preventing Agent (i)
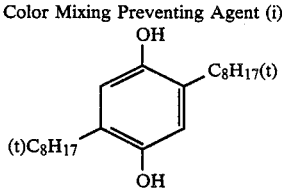
Solvent (j)
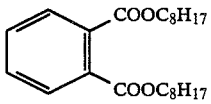
Cyan Coupler (k)
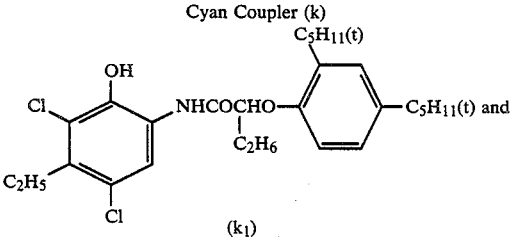
($k_1$)
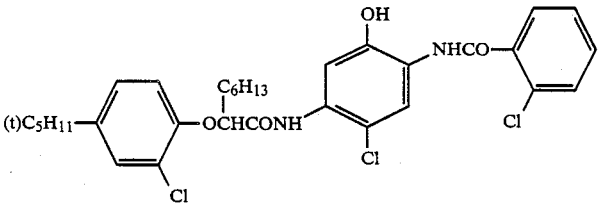
($k_2$)
Mixture of 1:1 in mol ratio
Dye Image Stabilizer (l)

-continued

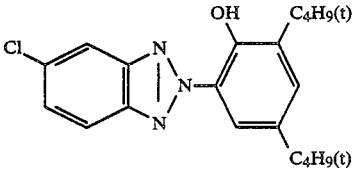

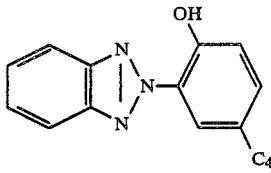

and

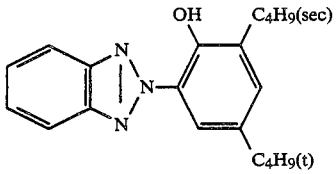

Mixture of 1:3:3 in mol ratio

Magenta Coupler (m)

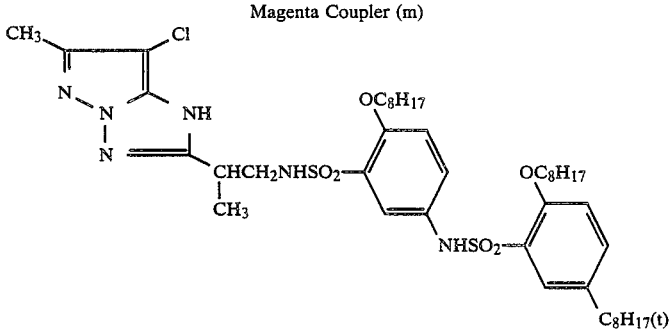

The color photographic paper thus prepared was wedge-exposed and then processed in the following processing steps.

| Processing Step | Temperature | Time |
|---|---|---|
| Color Development | 35° C. | 45 sec. |
| Blix | 35° C. | 45 sec. |
| Rinse 1 | 35° C. | 20 sec. |
| Rinse 2 | 35° C. | 20 sec. |
| Rinse 3 | 35° C. | 20 sec. |
| Drying | 80° C. | 60 sec. |

The compositions of the processing solutions used for the processing were as follows.

| | |
|---|---|
| Color Developer | |
| N,N—Diethylhydroxylamine | 4 g |
| Potassium Carbonate | 30 g |
| EDTA.2Na.2$H_2O$ | 2 g |
| Sodium Chloride | 1.0 g |
| 4-Amino-3-methyl-N—ethyl-N—[β-(methanesulfonamido)ethyl]-p-phenylenediamine Sulfate | 5.0 g |
| Brightening Agent (4,4'-diaminostilbene-series) | 3.0 g |
| Compound of the general formula (I) | shown in Table 1 |
| Water to make | 1,000 ml |
| pH | 10.10 |
| EDTA: Ethylenediaminetetraacetic acid | |
| Blix Solution | |
| EDTA Fe(III)$NH_4$.2$H_2O$ | 60 g |
| EDTA.2Na·2$H_2O$ | 4 g |

-continued

| | |
|---|---|
| Ammonium Thiosulfate (70%) | 120 ml |
| Sodium Sulfite | 16 g |
| Glacial Acetic Acid | 7 g |
| Water to make | 1,000 ml |
| pH | 5.5 |
| EDTA: Ethylenediaminetetraacetic acid | |
| Rinse Solution | |
| 1-Hydroxyethylidene-1,1-diphosphonic Acid (60%) | 1.6 ml |
| Bismuth Chloride | 0.35 g |
| Polyvinylpyrrolidone | 0.25 g |
| Aqueous Ammonia (26%) | 2.5 ml |
| Nitrilotriacetate Acid 3Na | 1.0 g |
| EDTA.4$H_2O$ | 0.5 g |
| Sodium Sulfite | 1.0 g |
| 5-Chloro-2-methyl-4-isothiazolin-3-one | 50 mg |
| Formalin (37%) | 0.1 ml |
| Water to make | 1,000 ml |
| pH | 7.0 |

Furthermore, after allowing to stand a part of the color developer having the above-described composition in an open system of 1 liter beaker for 20 days at 40° C., the color photographic paper having the same layer structure as described above was also processed by the same processing steps as above using the color developer.

The processing using the color developer allowed to stand for 20 days is called an aged solution test and the processing using the color developer before allowing to stand is called as fresh solution test.

The photographic properties obtained by the fresh solution test and the photographic properties obtained by the aged solution test are shown in Table 1 below.

The photographic properties are shown by Dmin in yellow density, sensitivity, and gradation.

The sensitivity is shown by a density value at a constant exposure amount (100 CMS) and the gradation is shown by the density change from the density point of 0.5 to the density point at the higher exposure side by 0.3 in logE.

From Table 1, it can be seen that according to this invention, even when the color developer is allowed to stand for a long period of time in an open system, the photographic properties obtained using the developer scarcely changes and almost constant performance is obtained. On the other hand, when sodium sulfite or triethanolamine is used, the composition of the color developer changes with the passage of time to increase fog and change the gradation of photographic images formed.

TABLE 1

| Experiment | | | Fresh Solution Test | | | Changes in Aged Solution Test at 40° C. | | |
|---|---|---|---|---|---|---|---|---|
| No. | Added Compound | (mol/l) | Dmin | Sensitivity | Gradation | Dmin | Sensitivity | Gradation |
| 1 | — | | 0.11 | 0.62 | 0.72 | 0.18 | 0.61 | 0.80 |
| 2 | Sodium Sulfite | $1.5 \times 10^{-2}$ | 0.11 | 0.58 | 0.65 | 0.13 | 0.60 | 0.69 |
| 3 | Triethanolamine | $7 \times 10^{-2}$ | 0.11 | 0.63 | 0.71 | 0.15 | 0.65 | 0.76 |
| 4 | I-(1) | " | 0.11 | 0.63 | 0.72 | 0.11 | 0.63 | 0.72 |
| 5 | I-(4) | " | 0.11 | 0.61 | 0.73 | 0.11 | 0.62 | 0.73 |
| 6 | I-(11) | " | 0.12 | 0.62 | 0.72 | 0.11 | 0.62 | 0.73 |
| 7 | I-(13) | " | 0.11 | 0.61 | 0.72 | 0.11 | 0.62 | 0.72 |
| 8 | I-(17) | " | 0.12 | 0.63 | 0.73 | 0.11 | 0.63 | 0.72 |
| 9 | I-(3) | " | 0.11 | 0.61 | 0.72 | 0.11 | 0.63 | 0.72 |
| 10 | I-(6) | " | 0.12 | 0.63 | 0.72 | 0.11 | 0.62 | 0.72 |
| 11 | I-(15) | " | 0.11 | 0.62 | 0.73 | 0.11 | 0.62 | 0.73 |

Note:
Exp. Nos. 1 to 3: Comparison examples
Exp. Nos. 4 to 11: Examples of this invention

EXAMPLE 2

A color photographic paper having Layer 1 (lowermost layer) to Layer 7 (uppermost layer) shown below on a paper both surfaces of which were coated with polyethylene followed by corona discharging treatment was prepared.

The coating composition for Layer 1 was prepared as follows.

A mixture of 200 g of the yellow coupler shown below, 93.3 g of fading preventing agent (r) shown below, 10 g of high boiling solvent (p), 5 g of high boiling solvent (g) shown below, and 600 ml of ethyl acetate as an auxiliary solvent was heated to 60° C. to dissolve the coupler and the fading preventing agent, the solution thus obtained was mixed with 3,300 ml of an aqueous 5% gelatin solution containing 330 ml of an aqueous 5% solution of Alkanol B (alkylnaphthalene sulfonate, made by DuPont), and the resultant mixture was emulsified using a colloid mill to provide a coupler dispersion. Then, ethyl acetate was distilled off from the dispersion under reduced pressure, the residue was mixed with 1,400 g of a silver halide emulsion (containing 96.7 g silver halide as Ag and 170 g of gelatin) added with a sensitizing dye for a blue-sensitive emulsion layer and 1-methyl-2-mercapto-5-acetylamino-1,3,4-triazole, and then 2,600 g of an aqueous 10% gelatin solution was further added to the mixture to provide the coating composition for Layer 1.

The coating composition for Layer 2 to Layer 7 were also prepared according to the aforesaid method.

In addition, for the silver halide emulsion layers were used the following sensitizing dyes.

For Blue-Sensitive Emulsion Layer:

Anhydro-5-methoxy-5'-methyl-3,3'-disulfopropylselenacyanine hydroxide

For Green-Sensitive Emulsion Layer:

Anhydro-9-ethyl-5,5'-diphenyl-3,3'-disulfoethyloxacarbocyanine hydroxide

For Red-Sensitive Emulsion Layer:

3,3'-Diethyl-5-methoxy-9,9'-(2,2-dimethyl-1,3-propano)thiadicarbocyanine iodide.

Also, for the emulsion layers was used 1-methyl-2-mercapto-5-acetylamino-1,3,4-triazole as a stabilizer.

Also, the following compounds were used as irradiation preventing dyes.

4-(3-Carboxy-5-hydroxy-4-(3-(3-carboxy-5-oxo-1-(4-sulfonaphthophenyl)-3-pyrazolin-4-iridene)-1-propenyl)-1-pyrazolyl)benzenesulfonate di-potassium salt.

N,N'-(4,8-Dihydroxy-9,10-dioxo-3,7-disulfonatoanthracene-1,5-diyl)bis(aminomethanesulfonate) tetrasodium salt.

Furthermore, 1,2-bis(vinylsulfonyl)ethane was used for the aforesaid layers as a gelatin hardening agent.

The layer structures were as follows.

| | | |
|---|---|---|
| Layer 1 | Blue-Sensitive Emulsion Layer | |
| | Silver chlorobromide emulsion (silver bromide 5 mol %) | 290 mg/m$^2$ |
| | Yellow coupler (shown below) | 600 mg/m$^2$ |
| | Fading preventing agent (r) | 280 mg/m$^2$ |
| | Solvent (p) | 30 mg/m$^2$ |
| | Solvent (q) | 15 mg/m$^2$ |
| | Gelatin | 1800 mg/m$^2$ |
| Layer 2 | Interlayer | |
| | Silver bromide emulsion (primitive, grain size 0.05 μm) | 10 mg/m$^2$ as silver |
| | Color mixing preventing agent (s) | 55 mg/m$^2$ |
| | Solvent (p) | 30 mg/m$^2$ |
| | Solvent (q) | 15 mg/m$^2$ |
| | Gelatin | 800 mg/m$^2$ |
| Layer 3 | Green-Sensitive Emulsion Layer | |
| | Silver chlorobromide emulsion (silver bromide 3 mol %) | 305 mg/m$^2$ |
| | Magenta coupler (shown below) | 670 mg/m$^2$ |
| | Fading preventing agent (t) | 150 mg/m$^2$ |
| | Fading preventing agent (u) | 10 mg/m$^2$ |
| | Solvent (p) | 200 mg/m$^2$ |
| | Solvent (q) | 10 mg/m$^2$ |
| | Gelatin | 1400 mg/m$^2$ |
| Layer 4 | Color Mixing Preventing Layer | |
| | Color mixing preventing agent (s) | 65 mg/m$^2$ |

-continued

| | | |
|---|---|---|
| | Ultraviolet absorbent (n) | 450 mg/m$^2$ |
| | Ultraviolet absorbent (o) | 230 mg/m$^2$ |
| | Solvent (p) | 50 mg/m$^2$ |
| | Solvent (q) | 50 mg/m$^2$ |
| | Gelatin | 1700 mg/m$^2$ |
| Layer 5 | Red-Sensitive Emulsion Layer | |
| | Silver chlorobromide emulsion (silver bromide 1 mol %) | 210 mg/m$^2$ |
| | Cyan coupler (C-2) | 260 mg/m$^2$ |
| | Cyan coupler (C-1) | 120 mg/m$^2$ |
| | Fading preventing agent (r) | 250 mg/m$^2$ |
| | Solvent (p) | 160 mg/m$^2$ |
| | Solvent (q) | 100 mg/m$^2$ |
| | Gelatin | 1800 mg/m$^2$ |
| Layer 6 | Ultraviolet Absorbing Layer | |
| | Ultraviolet absorbent (n) | 260 mg/m$^2$ |
| | Ultraviolet absorbent (o) | 70 mg/m$^2$ |
| | Solvent (p) | 300 mg/m$^2$ |
| | Solvent (q) | 100 mg/m$^2$ |
| | Gelatin | 700 mg/m$^2$ |
| Layer 7 | Protective Layer | |
| | Gelatin | 600 mg/m$^2$ |

The compounds used for the layers described above were as follows.

Ultraviolet Absorbent (n):

2-(2-Hydroxy-3,5-di-tert-amylphenyl)benzotriazole

Ultraviolet Absorbent (o):

2-(2-Hydroxy-3,5-di-tert-butylphenyl)benzotriazole:

Solvent (p):

Di(2-ethylhexyl) phthalate

Solvent (q):

Dibutyl phthalate

Fading Preventing Agent (r):

2,5-Di-tert-amylphenyl-3,5-di-tert-butylhydroxy benzoate

Color Mixing Preventing Agent (s):

2,5-Di-tert-octylhydroquinone

Fading Preventing Agent (t):

1,4-Di-tert-amyl-2,5-dioctyloxybenzene

Fading Preventing Agent (u):

2,2'-Methylenebis(4-methyl-6-tert-butylphenol)

Yellow Coupler:

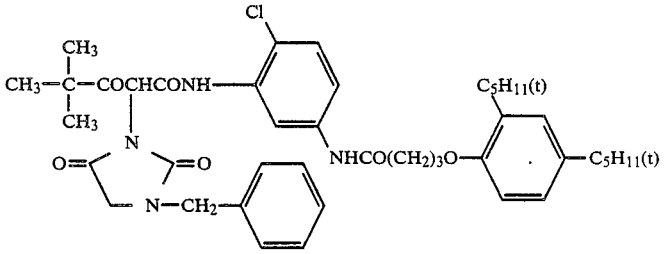

Magenta Coupler:

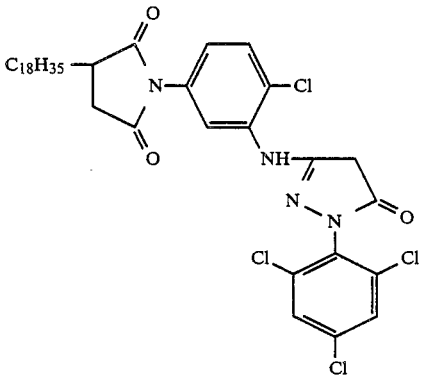

Cyan Coupler:

(Mixture of 50:50 in mol ratio)

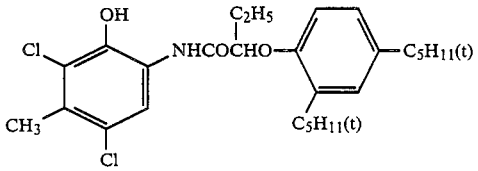

(C-1)

-continued

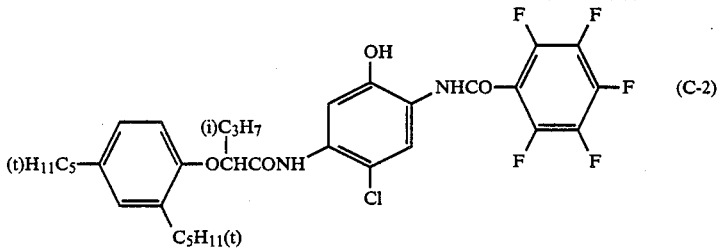

The multilayer color photographic paper thus prepared was wedge-exposed and processed by the following processing steps.

| Processing Step | Temperature | Time |
|---|---|---|
| Color Development | 33° C. | 3 min. 30 sec. |
| Blix | 33° C. | 1 min. 30 sec. |
| Rinse (3 tanks cascade) | 30° C. | 3 min. |
| Drying | 80° C. | 1 min. |

The compositions of the processing solutions used in the processing steps were as follows.

| | |
|---|---|
| Color Developer | |
| Water | 800 ml |
| Benzyl alcohol | shown in Table 2 |
| Diethylene glycol | shown in Table 2 |
| Diethylenetriaminepentaacetic acid | 1.0 g |
| N,N'—Bis(2-hydroxybenzyl)ethylenediamine-N,N'—diacetic acid | 0.1 g |
| Nitrilo-N,N,N—trimethylenephosphonic acid (40%) | 1.0 g |
| Potassium bromide | 1.0 g |
| Compound of the general formula (I) | shown in Table 2 |
| Hydroxylamine | shown in Table 2 |
| Potassium carbonate | 30 g |
| N—Ethyl-N—(β-methanesulfonamidoethyl)-3-methyl-4-aminoaniline sulfate | 5.5 g |
| Brightening agent (4,4'-diaminostilbene-series) | 1.0 g |
| Water to make | 1,000 ml |
| pH adjusted to KOH | 10.10 |
| Blix Solution | |
| Ammonium thiosulfate (70%) | 150 ml |
| Sodium sulfite | 15 g |
| Ethylenediamine iron(III) ammonium | 60 g |

-continued

| | |
|---|---|
| Ethylenediaminetetraacetic acid | 10 g |
| Brightening agent (4,4'-diaminostilbene-series) | 1.0 g |
| 2-Mercapto-5-amino-3,4-thiadiazole | 1.0 g |
| Water to make | 1,000 ml |
| pH adjusted to aqueous ammonia | 7.0 |
| Rinse Solution | |
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| Bismuth chloride (40%) | 0.5 g |
| Nitrilo-N,N,N—trimethylenephosphonic acid (40%) | 1.0 g |
| 1-Hydroxyethylidene-1,1-diphosphonic acid (60%) | 2.5 g |
| Brightening agent (4,4'-diaminostilbene-series) | 1.0 g |
| Aqueous ammonia (26%) | 2.0 ml |
| Water to make | 1,000 ml |
| pH adjusted by KOH | 7.5 |

As in Example 1, Dmin of magenta, sensitivities, and gradations in the fresh solution test and the aged solution test were measured and the changed values of the photographic properties with the photographic properties in the fresh solution test as standard are shown in Table 2 below.

TABLE 2

| Exp. No. | A/B (ml/l)/(ml/l) | Hydroxylamines (0.04 mol/l) | Compounds of The General Formula (I) (0.1 mol/l) | Change of Photographic Properties of Aged Solution Test Dmin | Sensitivity | Gradation |
|---|---|---|---|---|---|---|
| 12 | 15/10 | — | — | +0.21 | +0.23 | +0.13 |
| 13 | " | II-(5) | — | +0.10 | +0.10 | +0.06 |
| 14 | " | II-(34) | Triethanolamine | +0.10 | +0.06 | +0.08 |
| 15 | " | — | I-(1) | +0.07 | +0.07 | +0.03 |
| 16 | " | II-(33) | I-(1) | +0.03 | +0.03 | +0.02 |
| 17 | " | II-(5) | I-(1) | +0.02 | +0.02 | 0 |
| 18 | " | II-(5) | I-(4) | +0.01 | +0.01 | 0 |
| 19 | — | II-(5) | — | +0.08 | +0.08 | +0.06 |
| 20 | — | II-(34) | Triethanolamine | +0.09 | +0.06 | +0.07 |
| 21 | — | — | I-(1) | +0.05 | +0.05 | +0.03 |
| 22 | — | II-(33) | I-(1) | +0.02 | +0.02 | 0 |
| 23 | — | II-(5) | I-(1) | +0.01 | +0.01 | 0 |
| 24 | — | II-(33) | I-(4) | +0.02 | +0.02 | 0 |
| 25 | — | II-(5) | I-(4) | +0.01 | +0.01 | 0 |

A: Benzyl Alcohol
B: Diethylene Glycol
Note:
Exp. Nos. 12 to 14, 19, 20: Comparison Examples
Exp. Nos. 15 to 18, 21 to 25: Examples of this invention From the results shown in Table 2 above, it can be seen that the color developer composition in this invention shows excellent effect in the system containing benzyl alcohol and, in particular, it gives very stable photographic properties when it is used for the system containing no benzyl alcohol (Experiment Nos. 15, 16, 17, 18, 21, 22, 23, 24 and 25). On the other hand, in the case of using a hydroxylamine singly, the property of the color developer is changed with the passage of time to greatly change the photographic properties.

EXAMPLE 3

A color photographic paper was prepared by the same method as in Example 2 except that the silver halide composition in the silver halide emulsion for Layer 3 was changed to 80 mol % silver bromide and when the change of photographic properties was tested using the color developer stored in the same manner as in Experiment Nos. 12 to 25, the photographic properties were greatly changed by the change with the passage of time of the color developer during the storage in the case of using a hydroxylamine singly, like Example 2, while in the case of using the color developer composition for use in this invention, the composition showed very high stability particularly in the system containing no benzyl alcohol.

EXAMPLE 4

The photographic properties in the fresh solution test and the aged solution test were conducted by the same method as in Example 1 except that the compounds shown in Table 3 below were used in place of the compounds of the general formula (I) in the color developer. The results obtained are shown in Table 3 below.

From the results of the table, it can be seen that according to the process of this invention, the photographic properties scarcely change using color developer stored for a long period of time.

TABLE 3

| Experiment No. | Added Compound | (mol/l) | Fresh Solution Test Dmin | Sensitivity | Gradation | Changes in Aged Solution Test at 40° C. Dmin | Sensitivity | Gradation |
|---|---|---|---|---|---|---|---|---|
| 26 | I-(43) | $7 \times 10^{-2}$ | 0.11 | 0.63 | 0.72 | 0.11 | 0.63 | 0.72 |
| 27 | I-(44) | " | 0.11 | 0.63 | 0.73 | 0.11 | 0.63 | 0.72 |
| 28 | I-(46) | " | 0.11 | 0.62 | 0.72 | 0.11 | 0.63 | 0.72 |
| 29 | I-(50) | " | 0.11 | 0.64 | 0.73 | 0.11 | 0.65 | 0.72 |
| 30 | I-(54) | " | 0.12 | 0.62 | 0.72 | 0.12 | 0.63 | 0.72 |
| 31 | I-(56) | " | 0.11 | 0.63 | 0.72 | 0.11 | 0.63 | 0.72 |
| 32 | I-(59) | " | 0.11 | 0.64 | 0.72 | 0.11 | 0.64 | 0.72 |

Note:
Exp. Nos. 26 to 32: Examples of this invention

EXAMPLE 5

The change of photographic properties by the color developer stored for a long period of time were tested by the same method as in Example 2 except that the compounds of the general formula (I), hydroxylamines, and the ratio of benzyl alcohol/diethylene glycol in the color developers were changed as shown in Table 4 below. The results obtained are shown in Table 4 below.

From the results shown in Table 4, it can be seen that according to the process of this invention, the photographic performance was greatly stabilized.

TABLE 4

| Exp. No. | A/B (ml/l)/(ml/l) | Hydroxylamines (0.04 mol/l) | Compounds of The General Formula (I) (0.1 mol/l) | Change of Photographic Properties of Aged Solution Test Dmin | Sensitivity | Gradation |
|---|---|---|---|---|---|---|
| 33 | 15/10 | II-(5) | I-(24) | +0.02 | +0.02 | +0.01 |
| 34 | " | II-(33) | I-(24) | +0.02 | +0.02 | +0.01 |
| 35 | " | II-(5) | I-(43) | +0.01 | +0.02 | 0 |
| 36 | " | II-(33) | I-(43) | +0.01 | +0.02 | 0 |
| 37 | " | II-(5) | I-(50) | +0.02 | +0.01 | +0.01 |
| 38 | " | II-(33) | I-(50) | +0.02 | +0.01 | 0 |
| 39 | " | II-(5) | I-(56) | +0.01 | +0.01 | 0 |
| 40 | " | II-(33) | I-(56) | +0.02 | +0.01 | 0 |
| 41 | — | II-(5) | I-(24) | 0 | +0.01 | 0 |
| 42 | — | II-(33) | I-(24) | +0.01 | +0.01 | 0 |
| 43 | — | II-(5) | I-(43) | +0.01 | 0 | +0.01 |
| 44 | — | II-(33) | I-(43) | +0.01 | +0.01 | +0.01 |
| 45 | — | II-(5) | I-(50) | 0 | +0.01 | 0 |
| 46 | — | II-(33) | I-(50) | 0 | +0.01 | 0 |
| 47 | — | II-(5) | I-(56) | 0 | 0 | 0 |
| 48 | — | II-(33) | I-(56) | 0 | 0 | 0 |

A: Benzyl Alcohol
B: Diethylene Glycol
Note:
Exp. Nos. 33 to 48: Examples of this invention While the invention has been described in detail and with reference to specific embodiments thereof, it will be apparent to one skilled in the art that various changes and modifications can be made therein without departing from the spirit and scope thereof.

What is claimed is:

1. A process for processing silver halide color photographic materials, which comprises processing, after imagewise exposure, a silver halide color photographic material, which silver halide color photographic material contains at least one color coupler, with a color developer containing an aromatic primary amine color developing agent and a compound represented by the following general formula (I):

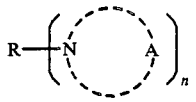

(I)

wherein n represents an integer of at least 1; R represents a hydrogen atom, a substituted or unsubstituted alkyl group, or an n-valent group corresponding to the alkyl group when n represents an integer of at least 2; and A represents an organic group containing a carbon atom, an oxygen atom, a nitrogen atom, or a sulfur atom and forms a saturated or unsaturated 3- to 8-membered ring with the nitrogen atom, said A is substituted or unsubstituted and may be condensed with a benzene ring or a heterocyclic ring.

2. The process for processing silver halide color photographic materials as claimed in claim 1, wherein n represents an integer of from 1 to 3.

3. The process for processing silver halide color photographic materials as claimed in claim 1, wherein R represents a hydrogen atom or a substituted or unsubstituted alkyl group.

4. The process for processing silver halide color photographic materials as claimed in claim 1, wherein n represents 1; R represents a substituted or unsubstituted alkyl group; and A represents an organic group containing a carbon atom, an oxygen atom or a nitrogen atom and forms a saturated or unsaturated 5-membered or 6-membered ring with the nitrogen atom.

5. The process for processing silver halide color photographic materials as claimed in claim 4, wherein R represents an alkyl group substituted by a hydrophilic functional group, which has 1 to 10 carbon atoms.

6. The process for processing silver halide color photographic materials as claimed in claim 1, wherein the color developer contains substantially no benzyl alcohol.

7. The process for processing silver halide color photographic materials as claimed in claim 1, wherein the color developer further contains a hydroxylamine represented by the following general formula (II):

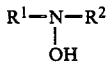

(II)

wherein, $R^1$ and $R^2$, which may be the same or different, each represents a hydrogen atom, a substituted or unsubstituted alkyl group, a substituted or unsubstituted alkenyl group, or a substituted or unsubstituted aryl group, and $R^1$ and $R^2$ may combine to form a nitrogen-containing heterocyclic group.

* * * * *